US005784668A

United States Patent [19]

Hyakutake et al.

[11] Patent Number: 5,784,668

[45] Date of Patent: Jul. 21, 1998

[54] IMAGE FORMING APPARATUS

[75] Inventors: Nobuo Hyakutake; Yoshihiro Enomoto; Junichi Hama; Tetsuya Fujita; Nobuyoshi Komatsu, all of Ebina, Japan

[73] Assignee: Fuji Xerox Co., Ltd., Tokyo, Japan

[21] Appl. No.: 797,987

[22] Filed: Feb. 12, 1997

[30] Foreign Application Priority Data

Feb. 16, 1996 [JP] Japan ..... 8-052545
Jan. 22, 1997 [JP] Japan ..... 9-023295

[51] Int. Cl.[6] ..... G03G 15/06; G03G 21/00

[52] U.S. Cl. ..... 399/55; 399/40; 399/44; 399/45; 399/66

[58] Field of Search ..... 399/40, 44, 45, 399/55, 66, 298, 299, 302, 303, 310, 314; 430/124, 126, 48, 42

[56] References Cited

U.S. PATENT DOCUMENTS

| | | | |
|---|---|---|---|
| 4,888,618 | 12/1989 | Ishikawa | 399/39 |
| 4,912,515 | 3/1990 | Amemiya et al. | 399/44 |
| 5,003,351 | 3/1991 | Waki et al. | 399/231 |
| 5,036,360 | 7/1991 | Paxon et al. | 399/46 |
| 5,148,218 | 9/1992 | Nakane et al. | 399/9 |
| 5,182,603 | 1/1993 | Yamada | 399/298 |
| 5,187,535 | 2/1993 | Tajima | 399/231 |
| 5,225,872 | 7/1993 | Fukushima | 399/39 |
| 5,276,483 | 1/1994 | Hasegawa et al. | 399/44 |

FOREIGN PATENT DOCUMENTS

| | | |
|---|---|---|
| 60-159765 | 8/1985 | Japan . |
| 60-159767 | 8/1985 | Japan . |
| A-62-119563 | 5/1987 | Japan . |
| 05-346724 | 12/1993 | Japan . |
| 06-282146 | 10/1994 | Japan . |
| 07-261497 | 10/1995 | Japan . |
| 08-016001 | 1/1996 | Japan . |

*Primary Examiner*—Matthew S. Smith
*Attorney, Agent, or Firm*—Oliff & Berridge, PLC

[57] ABSTRACT

In an image forming apparatus wherein plural developing devices 3 have alternating electric field applying mechanisms 4, the alternating electric field applying mechanisms 4 have alternating electric field changing mechanisms 7 for reducing the degree of the action of the alternating electric field on at least one of the developing devices 3 which are later in development order, to a level which is lower than that in the preceding step. As required, at least one of the transferring devices 5 which are later in transfer order has a transfer force changing mechanism 8 for increasing the force of transfer to a transfer medium 6 applied to a color-component toner image on an image carrier 1, to a level which is higher than that in the preceding step. Furthermore, an operation condition judging mechanism 9 may judge whether preset transfer failure conditions are satisfied or not, or environmental conditions may be considered by an environmental condition adjusting device 10.

10 Claims, 16 Drawing Sheets

IMAGE FORMING APPARATUS

BACKGROUND OF THE INVENTION

1. Field of the Invention

The invention relates to an image forming apparatus in which electrostatic latent images of color components formed on an image carrier are respectively developed by toner by plural developing means and the formed toner images are sequentially transferred to a transfer medium, and particularly to an improvement of an image forming apparatus of the type in which plural developing means develop electrostatic latent images by toner under action of an alternating electric field.

2. Description of the Related Art

As a color image forming apparatus using the electrophotographic system, an apparatus has been proposed in which electrostatic latent images of color components are formed on a latent image carrier such as a photosensitive drum, electrostatic latent images of color components are developed in developing devices containing toner of respective colors, and the developed toner images of color components are sequentially transferred in a multiple manner to a transfer material such as a paper sheet wound on a transfer drum, thereby obtaining a color image.

As an apparatus using a developing device of the non-contact developing type, an apparatus has been proposed in which an alternating electric field is applied as a developing bias so that developing toner is caused to travel between a latent image carrier and a developing roll, thereby enhancing the developing property (see Japanese Patent Unexamined Publication No. SHO 62-119563).

In such a color image forming apparatus of the multiple transfer type, there occurs an image defect in the transfer step as described below.

When toner images are transferred in a multiple manner, the difference among the pile heights of unfixed toner images which are previously transferred to a transfer material causes the gap between the transfer material and toner on a latent image carrier to be extremely increased, with the result that a transfer failure occurs.

When the system in which an alternating electric field is applied as a developing bias is employed, particularly, such a transfer failure noticeably occurs because a developed toner image exerts an increased adhesive force acting on the latent image carrier.

Particularly, such a transfer failure appears as an image defect of a peripheral void in the periphery of a character of a larger pile height.

The character peripheral void phenomenon occurs when an image is transferred around a character which is previously transferred to a transfer material, and is caused by the formation of a gap between the toner of the character and that of the image in the transfer region.

When the particle diameter of toner and the color material are once determined, the required quantity of toner is determined and the degree of a gap is known. Even in the case where toner of a particle diameter of 7 μm is used, for example, a gap of 50 μm or more may be formed.

When a gap is formed in the transfer region as described above, discharge due to electrostatic breakdown is caused to first occur around a character forming a large gap, by the electric field produced by a transfer device. Therefore, toner in the periphery of a character to be transferred is charged to the opposite polarity, resulting in that, even when the output of the transfer device is increased, the above-mentioned transfer failure cannot be improved.

Also an apparatus in which toner is subjected to a predetermined charging process by a pretransfer processing device such as a pretransfer corotron has been proposed. However, such a countermeasure is insufficient to function as means for improving the above-mentioned transfer failure.

When a water-contained low-resistivity paper sheet is used as a transfer material, the electric field in the transfer region is caused to spread so as to act also in the region in front of a transfer nip.

In this case, the electric field acts under a state where the transfer material is not in close contact with the latent image carrier. Therefore, a transfer failure due to the above-mentioned gap, particularly, a character peripheral void (white void in the periphery of a character) easily occurs.

In an image forming apparatus which functions as a copier and also as a printer, an output in the case where the apparatus functions as a printer may cause the image density to be higher than that obtained from an output in the case where the apparatus functions as a copier, i.e., an output obtained by reading an image by an IIT (Image Input Terminal) such as an image reader and then subjecting the image to image processing.

When such an apparatus functions as a printer, therefore, a character peripheral void due to the above-mentioned transfer failure easily occurs.

From the view point of improvement of the environment dependence of the charging property of a developing agent or a photosensitive drum, it is known to change bias conditions of a developing device in order to correct the development curve (for example, Japanese Patent Examined Publication No. HEI-2-41030).

Even when the development curve is controlled so as to be constant by means of a process control, however, the above-mentioned character peripheral void phenomenon remains to occur.

SUMMARY OF THE INVENTION

The invention has been conducted in order to solve the technical problems discussed above, and therefore an object of the invention is to provide an image forming apparatus which is of a type wherein plural developing means develop an electrostatic latent image by toner under action of an alternating electric field, and in which an image defect of a peripheral void in a character of a larger pile height is surely prevented from occurring in a transfer step.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Figure 1:
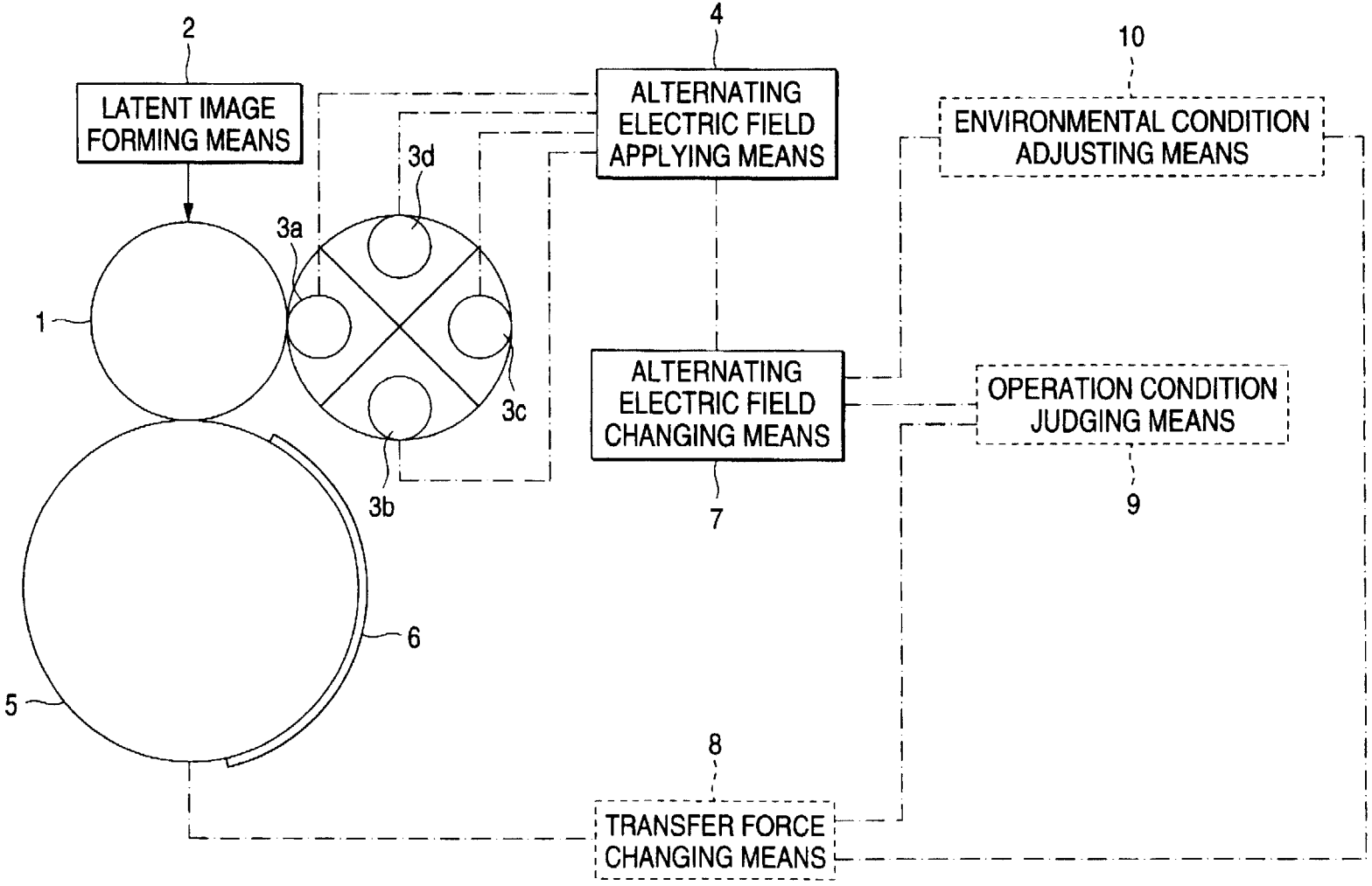
FIG. 1 is a diagram illustrating the configuration of the image forming apparatus of the invention.

As shown in FIG. 1, the apparatus of the invention comprises: one or more image carriers 1; latent image forming means 2 for sequentially forming electrostatic latent images of color components on the image carriers 1; plural developing means 3 (for example, 3*a*, 3*b*, 3*c*, 3*d*), arranged around the image carriers 1, for developing the electrostatic latent images on the image carriers 1 by toner of respective color components under action of an alternating electric field generated by alternating electric field applying means 4; and transferring means 5 for sequentially transferring color-component toner images formed on the image carriers 1 to a transfer medium 6, and is characterized in that the alternating electric field applying means 4 comprises alternating electric field changing means 7 for reducing a degree of an action of the alternating electric field on at least one of the developing means 3 which are later in development order, to a level which is lower than that in a preceding step.

In the technical means, the invention includes a color image forming apparatus of the multiple transfer type in which color-component toner images formed on the single image carrier 1 are sequentially transferred to the transfer medium 6, and also that in which the plural image carriers 1 are arranged in parallel and color-component toner images respectively formed on the image carriers 1 are sequentially transferred to the transfer medium 6.

Image carriers of any kind including drum-like ones and belt-like ones may be used as the image carriers 1 as far as they can carry a toner image. The transfer medium 6 includes not only sheets such as paper sheets which are used as final recording media, but also an intermediate transfer member such as an intermediate transfer belt.

As the transferring means 5, a transfer device of any kind, such as a device of the electrostatic transfer type, a device of the pressure transfer type, or a device in which the two types are combined may be suitably selected as far as it can sequentially transfer toner images-on the image carrier 1 to the transfer medium 6.

The plural developing means 3 are not restricted to a structure in which all the developing means 3 have the alternating electric field applying means 4, and may have a structure in which only a part of the developing means 3 have the alternating electric field applying means 4.

The developing means 3 having the alternating electric field applying means 4 is usually configured by a device of the noncontact and one-component developing type. A device of another type such- as the noncontact and two-component developing type may be used as the developing means as far as it can apply an alternating electric field.

It is requested to dispose the alternating electric field changing means 7 in at least one alternating electric field applying means 4 of the developing means 3 which are later in development order. Preferably, the alternating electric field changing means is disposed in each of the developing means 3 which are later in development order so that the degrees of actions of the alternating electric fields respectively acting on the developing means 3 which are later in development order are sequentially reduced.

The alternating electric field changing means 7 may be configured by means of any kind, as far as it can variably set the degree of an action of the alternating electric field. As the means, means for changing the peak-to-peak voltage of the alternating electric field, means for changing the duty ratio of the alternating electric field, or means in which the two means are combined may be suitably selected.

The changeable degree of an action of the alternating electric field may be preset to a range wherein an image defect of a character peripheral void does not occur.

From the view point that an image defect of a character peripheral void is surely prevented from occurring, it is preferable to dispose the transfer force changing means 8 for increasing the force of transfer to the transfer medium 6 applied to a color-component toner image on the image carrier 1, to a level which is higher than that in the preceding step, in at least one of the transferring means 5 which are later in transfer order.

In this case, preferably, the transfer force changing means 8 is disposed in each of the transferring means 5 which are later in transfer order, and the force of transfer to the transfer medium 6 applied to a color-component toner image on the image carrier 1 is more increased as the transfer order is later.

From the view point that a situation which may cause a transfer failure is surely prevented from occurring, operation condition judging means 9 may be disposed so that it is judged whether use conditions satisfy preset transfer failure conditions or not, and, when it is judged that the use conditions satisfy the transfer failure conditions, the alternating electric field changing means 7 is caused to operate, or the alternating electric field changing means 7 and the transfer force changing means 8 are caused to operate.

Examples of the preset transfer failure conditions include conditions wherein a transfer failure of a character peripheral void easily occurs, those wherein the transfer medium 6 of a kind which may easily cause a transfer failure is selected, and those wherein an image formation mode (such as the manual feed mode-or a print mode) which may easily cause a transfer failure is selected.

In a high-humidity environment, the transfer medium 6 contains water at a higher percentage, and hence an image quality defect due to the transfer failure easily occurs. From the view point that the image formation is effectively prevented from being affected by environmental conditions, it is preferable to dispose environmental condition adjusting means 10 so that, in accordance with environmental conditions, the degree of a change of the alternating electric field conducted by the alternating electric field changing means 7 is controlled or the degree of a change of the alternating electric field conducted by the alternating electric field changing means 7 and that of a change of the transfer force conducted by the transfer force changing means are controlled.

In an embodiment in which the environmental condition adjusting means 10 for controlling the degree of a change of the alternating electric field conducted by the alternating electric field changing means 7, and that of a change of the transfer force conducted by the transfer force changing means 8 is disposed, particularly, the apparatus may be configured so that the alternating electric field changing means 7 changes the strength of the alternating electric field and the transfer force changing means 8 changes the current flowing into the transfer medium 6. In this type, preferably, the environmental condition adjusting means 10 controls parameters in a range of $0.5<U<1.5$ where an alternating electric field strength at a high humidity is indicated by Vpp(High Hum), an alternating electric field strength at a low humidity is indicated by Vpp(Low Hum), a transfer flowing current at a high humidity is indicated by It(High Hum), a transfer flowing current at a low humidity is indicated by It(Low Hum), and U={It(High Hum)/It(Low Hum)}·{Vpp(Low Hum)/Vpp(High Hum)}.

Next, the function of the technical means will be described.

Referring to FIG. 1, the alternating electric field changing means 7 changes the application conditions of the alternating electric field of the alternating electric field applying means 4 so that the degree of an action of the alternating electric field acting on at least one of the developing means 3 which are later in development order, to a level which is lower than that in a preceding step.

Then, with respect to a toner image of a color which is later in development order, the adhesive force of the toner image acting on the image carrier 1 is reduced and the toner image of the color is held to the image carrier 1 in a state wherein it can be easily transferred. Even when a gap is formed between the transfer medium 6 and the image carrier 1 by the pile height of a toner image which is previously transferred to the transfer medium 6, therefore, the toner image on the image carrier 1 is satisfactorily transferred to the transfer medium 6.

In an image forming apparatus which includes the alternating electric field changing means 7 and in which the transfer force changing means 8 is disposed in at least one of the transferring means 5 which are later in transfer order, particularly, the transfer force changing means 8 increases the force of transfer to the transfer medium 6 applied to a color-component toner image on the image carrier 1, and hence the performance of transfer of a toner image on the image carrier 1 to the transfer medium 6 is further enhanced.

Hereinafter, embodiments of the invention shown in the accompanying drawings will be described in detail.

Embodiment 1

Figure 2:
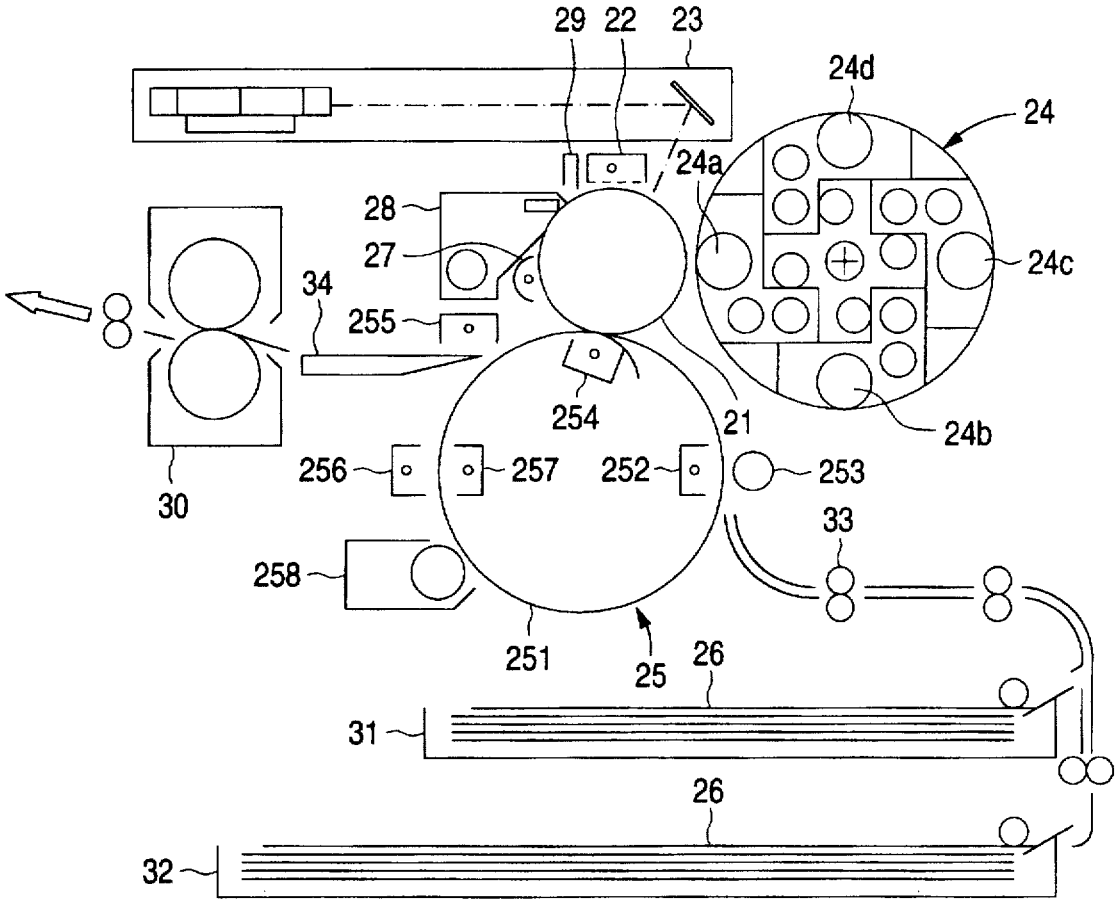
FIG. 2 is a diagram illustrating the configuration of an image forming apparatus of Embodiment 1.

FIG. 2 shows an embodiment of a color image forming apparatus to which the invention is applied.

In the figure, the reference numeral 21 designates a latent image carrier such as a photosensitive drum, 22 designates a uniform charger which previously charges the latent image carrier 21, 23 designates a laser exposure which draws an electrostatic latent image on the charged latent image carrier 21, and 24 designates a rotary developing device on which developers containing respective color developing agents, i.e., a black developer **24*a*, a yellow developer 24*b*, a magenta developer 24*c*, and a cyan developer 24*d* are rotatably mounted so that predetermined one of the developers 24*a* to 24*d* is intermittently rotated to a developing position opposing the latent image carrier-21. The reference numeral 25 designates a transfer device which transfers color toner images on the latent image carrier 21 to a transfer material 26 such as a paper sheet or a transparent sheet, 27 designates a cleaning preprocessing charger which discharges or charges the latent image carrier 21 before the cleaning step in order to facilitate the cleaning process, 28 designates a cleaning device which removes away residual toner on the latent image carrier 21, 29 designates a discharger which eliminates residual charges of the latent image carrier 21, and 30 designates a fixing device which fixes an unfixed toner image on the transfer material 26**.

The reference numerals 31 and 32 designate transfer material supply trays which supply the transfer material 26 of a predetermined size, 33 designates registration rolls which control the timing of supplying the transfer material 26 to a transfer drum 251, and 34 designates a transport guide member which guides the transfer material 26 that has completed the transfer step, to the fixing device 30.

Figure 3:
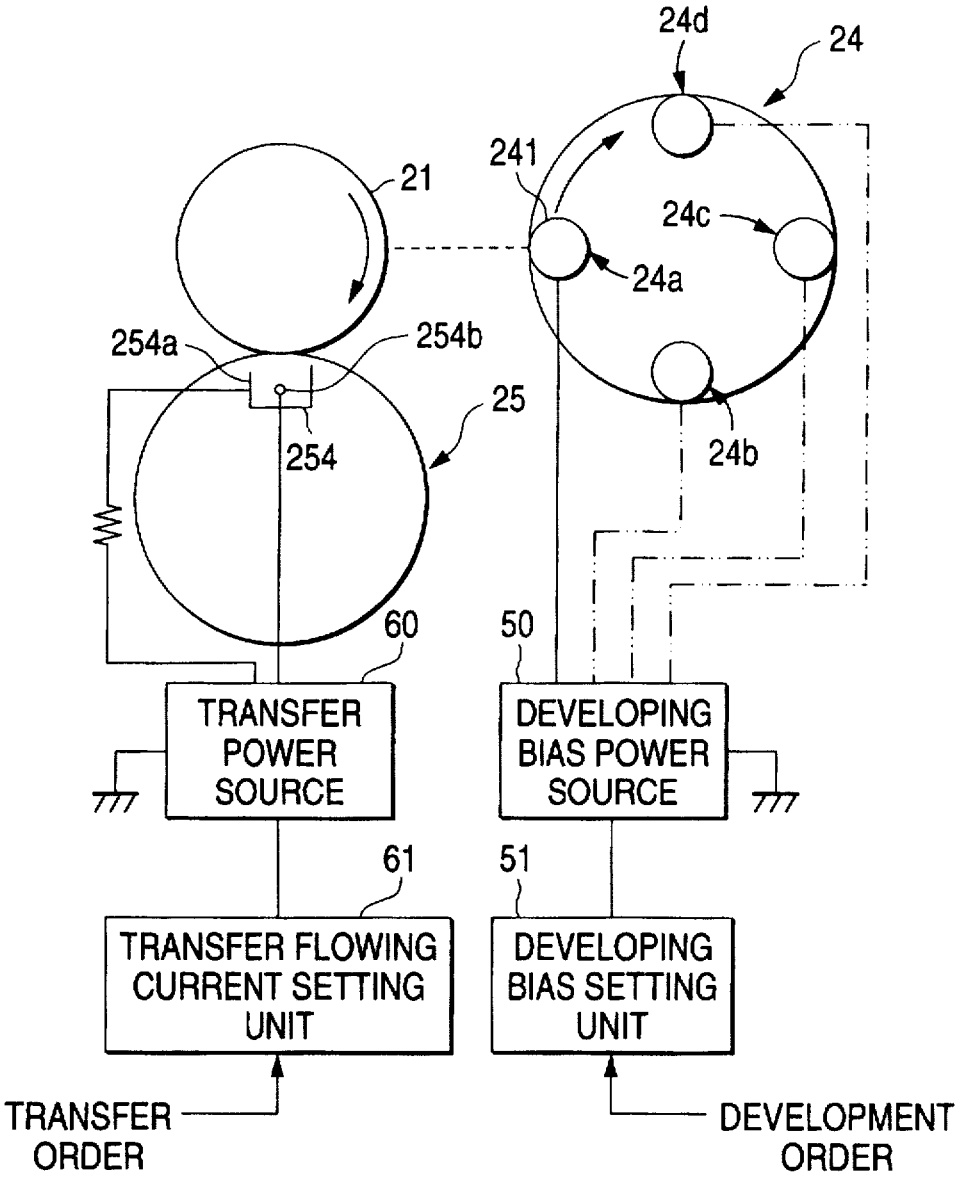
FIG. 3 is a diagram illustrating in detail a developing bias setting unit and a transfer flowing current setting unit in Embodiments 1 to 3.

In the embodiment, each-of the developers **24*a* to 24*d* of the rotary developing device 24 employs the two-component developing system and has a developing roll 241 which is to be opposed to the latent image carrier 21 as shown in FIG. 3. When each of the developers 24*a* to 24*d* is set to be at the developing position, the corresponding developing roll 241 is connected to a developing bias power source 50**.

Figure 4:
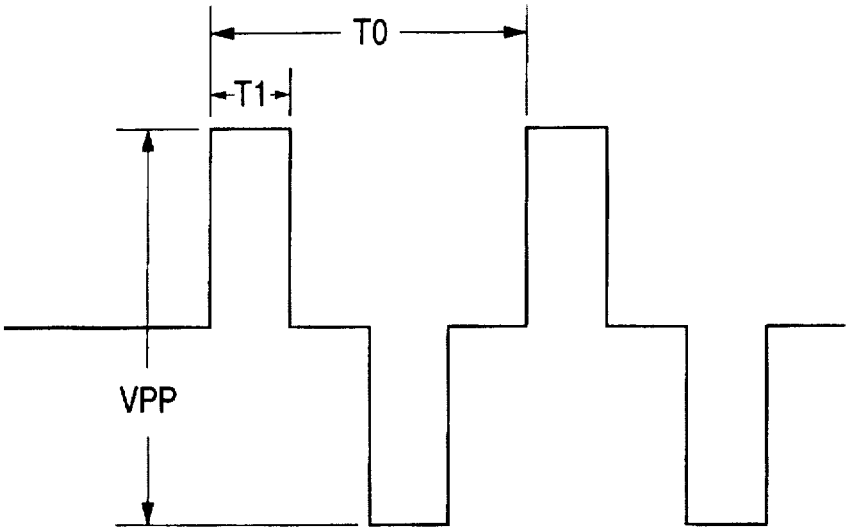
FIG. 4 is a diagram illustrating an alternating voltage of a developing bias in Embodiment 1.

In the embodiment, the developing bias power source 50 supplies to the developing roll 241 a developing bias on which an alternating voltage (peak-to-peak voltage: Vpp, duty ratio: T1/T0) such as shown in FIG. 4 is superimposed.

In the embodiment, particularly, a developing bias setting unit 51 is connected to the developing bias power source 50. The developing bias setting unit 51 gradually lowers the peak-to-peak voltage Vpp of the alternating voltage in accordance with the development order.

In the case where the development order is K (black)→Y (yellow)→M (magenta)→C (cyan), the peak-to-peak voltages Vpp of the alternating voltages of the developing biases of the developers **24*a* to 24*d*** are sequentially lowered in the sequence of the development order or set to be Vpp(K)>Vpp (Y)>Vpp(M) >Vpp(C).

The transfer device 25 comprises the transfer drum 251 in which an insulation sheet extends on the peripheral face and which is rotated in a predetermined direction. In a suction station which is on the downstream side in the rotation direction with respect to the transfer station of the transfer drum 251, a suction charger 252 and a suction charging roll 253 which cause the transfer material 26 to be electrostatically sucked to the transfer drum 251 are disposed so as to be opposed to each other through the transfer drum 251. A transfer charger 254 is disposed inside the transfer drum 251 at a position corresponding to the transfer station. A separation discharger 255 which separates the transfer material 26 from the transfer drum 251 is disposed at a separation station which is on the downstream side in the rotation direction with respect to the transfer position of the transfer drum 251. A pair of dischargers 256 and 257 are disposed so as to be opposed to each other through the transfer drum 251, on the further downstream side in the rotation direction of the transfer drum 251. A cleaning device 258 which removes away residual paper dust and the like on the transfer drum 251 is disposed on the further downstream side in the rotation direction of the transfer drum 251.

In the embodiment, the transfer charger 254 consists of a corona charger. As shown in FIG. 3, a transfer power source 60 is connected to a corona wire inside a shield 254*a*, and a transfer flowing current setting unit 61 is connected to the transfer power source 60. A transfer flowing current (the level of the current per unit length which flows into the latent image carrier 21) is set so as to be constant by the transfer flowing current setting unit 61.

Next, the image forming process of the color image forming apparatus of the embodiment will be described.

First, the surface of the latent image carrier 21 is uniformly charged to the negative polarity by the uniform charger 22. Next, the laser exposure 23 conducts the exposure of an image corresponding to the first color, for example, a black image, so that an electrostatic latent image corresponding to the black image is formed on the surface of the latent image carrier 21.

In the rotary developing device 24, the black developer 24*a* is positioned so as to oppose the latent image carrier 21 before the front end of the electrostatic latent image corresponding to the black image reaches the developing position. Thereafter, the electrostatic latent image on the latent image carrier 21 is developed by black toner under application of the predetermined developing bias (alternating voltage Vpp(K)).

On the other hand, the transfer material 26 is transported from the tray 31 or 32, and once blocked at the front end of the material by the registration rolls 33. The transfer material 26 is then sent out to a tucking point of the transfer drum 251 at a predetermined timing. The sent out transfer material 26 is caused by the suction charger 252 and the suction charging roll 253 to be electrostatically held to the transfer drum 251, and then transported to the transfer station where -the transfer drum 251 opposes the latent image carrier 21. In the station, the transfer material 26 is in close contact with the black toner image on the latent image carrier 21, and the black toner image is transferred to the transfer material 26 by the action of the transfer charger 254. The transfer drum 251 prepares for the next step while holding the transfer material 26.

The latent image carrier 21 which has completed the transfer of the black toner image is then subjected to a cleaning preprocessing as required. Thereafter, black toner remaining on the surface of the carrier is scraped off by the cleaning device 28, and charges remaining on the surface are eliminated by the discharger 29.

Next, in order to conduct the step of forming an image of the second color, for example, yellow, the surface of the latent image carrier 21 is uniformly charged to the negative polarity by the uniform charger 22. The laser exposure 23 conducts the exposure of an image corresponding to the yellow image, so that an electrostatic latent image corresponding to the yellow image is formed on the surface of the latent image carrier 21.

After the formation of the black toner image is completed, the developing device 24 is switched so that the yellow developer 24*b* opposes the latent image carrier 21. The electrostatic latent image corresponding to the yellow image is developed by yellow toner under application of the predetermined developing bias (alternating voltage Vpp(Y) <Vpp(K)). The transfer material 26 held to the transfer drum 251 is again transported to the transfer station, and the yellow toner image is transferred in a multiple manner onto the black toner image by the action of the transfer charger 254.

The latent image carrier 21 which has completed the transfer of the yellow toner image is then subjected to the cleaning of residual toner on the surface and the elimination of residual charges-in the same manner as the black image forming step. On the other hand, the transfer material 26 which has completed the transfer of yellow toner prepares for the next step while being held to the transfer drum 251.

In the same manner as the yellow image forming step, thereafter, the step of forming an image of the third color, for example, magenta is conducted (in the developing step, the alternating voltage Vpp(M) of the developing bias is set to be Vpp(M)<Vpp(Y)). Finally, the step of forming an image of the fourth color, for example, cyan is conducted (in the developing step, the alternating voltage Vpp(C) of the developing bias is set to be Vpp(C)<Vpp(M)). In the cyan image forming step which is final, the transfer material 26 is transferred in a manner different from the above-mentioned steps for the other three colors.

The transfer material 26 which has undergone the transfer of the fourth color is separated from the transfer drum 251 by the separation discharger 255 and separation fingers (which are not shown) at the front edge of the transport guide member 34. After the multiple toner image is fixed to the transfer material 26 by the fixing device 30, the transfer material 26 is transported to the outside of the image forming apparatus.

In the transfer drum 251 from which the transfer material has been separated, the surface is discharged by the dischargers 256 and 257, and the cleaning device 258 cleans the surface. Then, the-transfer drum 251 waits for the supply of the next transfer material 26.

Figure 5:
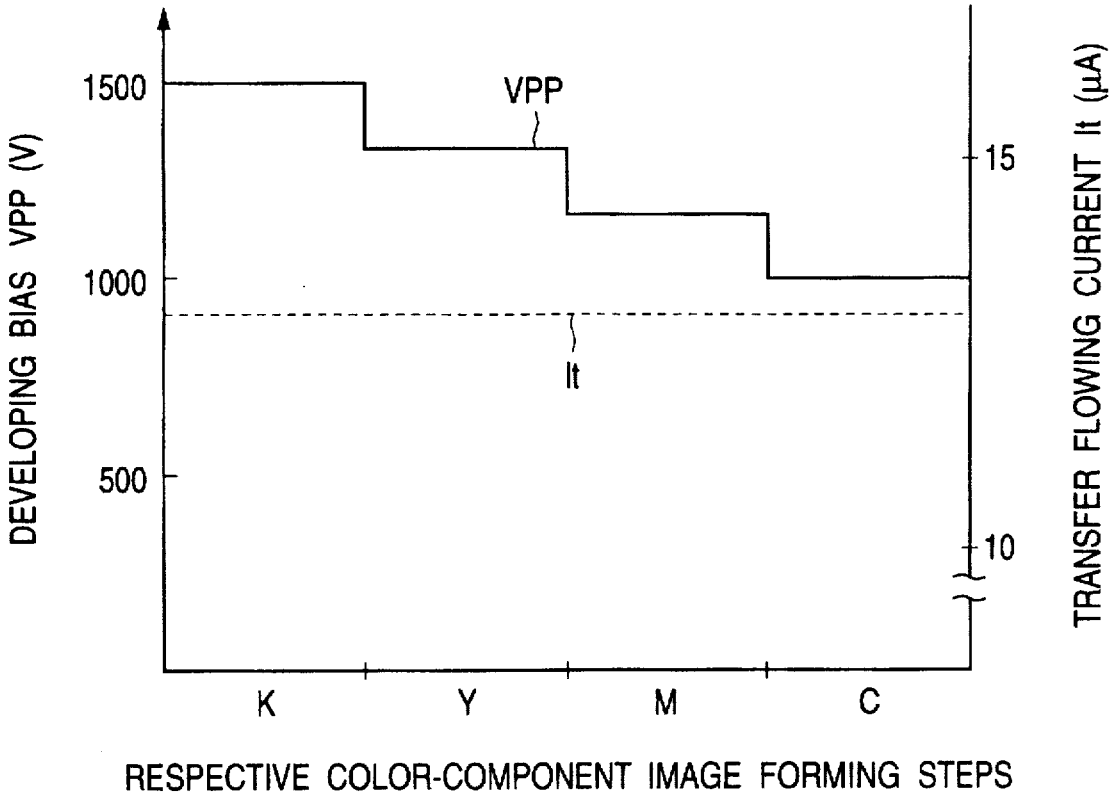
FIG. 5 is a diagram schematically showing the image forming process in Embodiment 1.

FIG. 5 shows the states of the peak-to-peak voltages Vpp and the transfer flowing current It of the respective color-component image forming steps in the image forming process.

As a specific example of the embodiment, images were formed in the following manner. The process speed of the latent image carrier 21 was 106 mm/sec., the transfer flowing current It of the transfer charger 254 had a predetermined value (for example, 13 μA) in the range of 10 to 16.5 μA per width (0.3 m), the gap DRS between the latent image carrier 21 and the developing rolls of the developers 24*a* to 24*d* was 0.5 mm, the frequency f of the alternating voltages of the developing biases of the developers 24*a* to 24*d* was 600 Hz, and the DC bias VDC was −550 V. The peak-to-peak voltages Vpp of the developing biases were sequentially lowered as 1,500 V (K), 1,350 V (Y), 1,200 V (M), and 1,000 V (C), in accordance with the development order of (K (black)→Y (yellow)→M (magenta) →C (cyan) ). As a result, it was confirmed that, as compared with the case where the peak-to-peak voltages Vpp of the developing biases are fixed to 1,500 V, a character peripheral void hardly occurs even when a character is transferred and the background is then transferred.

In the embodiment, the peak-to-peak voltages Vpp of the developing biases of the developers 24*a* to 24*d* are set to be Vpp(K)>Vpp(Y)>Vpp(M)>Vpp(C) or sequentially lowered in accordance with the development order. The invention is not restricted to this. The peak-to-peak voltage Vpp of at least one developing step may be set to be lower than that of the previous step in accordance with the development order, as far as it is in the range where the transfer performance can be maintained.

Figure 6A:
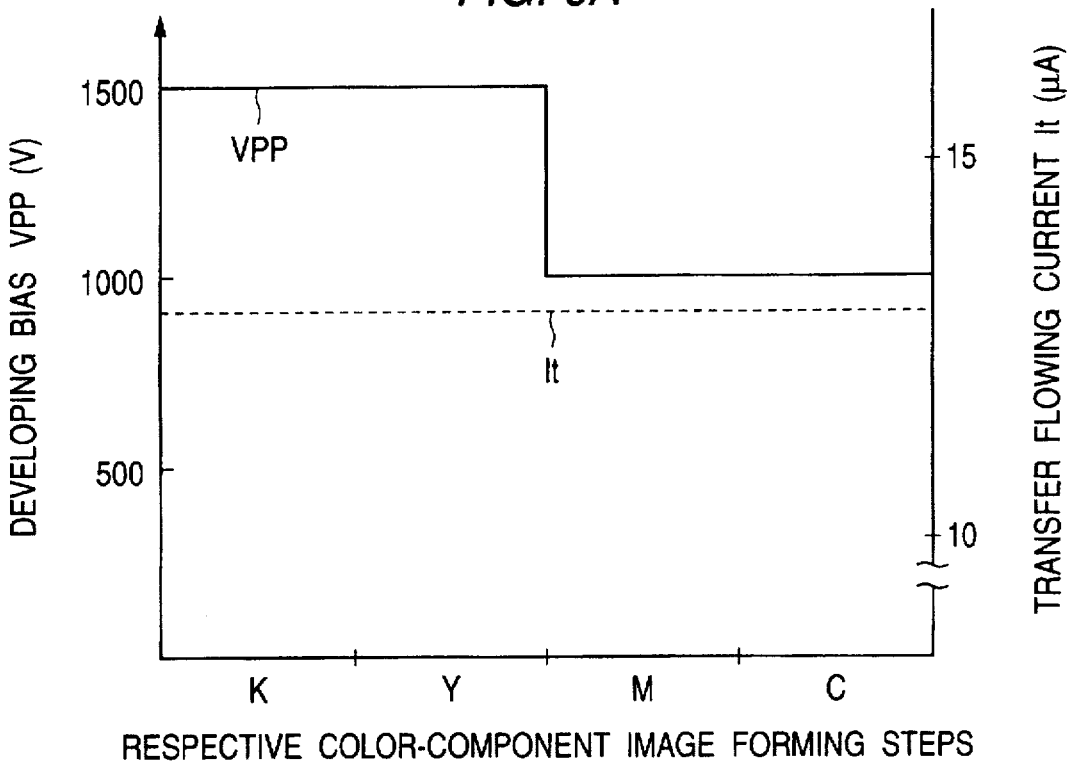
FIGS. 6A and 6B are diagrams illustrating modifications of the image forming process in the embodiment.
Figure 6B:
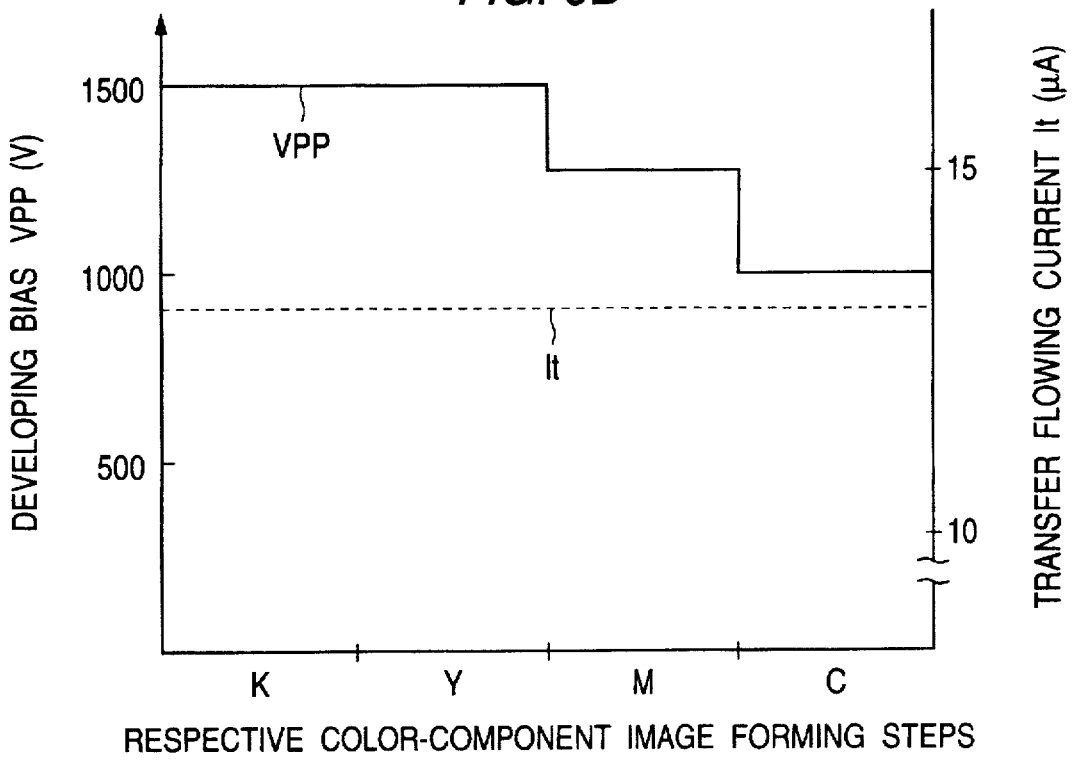

As shown in FIG. 6A, for example, Vpp(K) and Vpp(Y) may be set to be equal to each other (e.g., 1,500 V) and Vpp(M) and Vpp(C) may be set to be lower than that of the previous step (e.g., 1,000 V). Alternatively, as shown in FIG. 6B, Vpp(K) and Vpp(Y) may be set to be equal to each other (e.g., 1,500 V), Vpp(M) may be set to be lower than that of the previous step (e.g., 1,250 V), and Vpp(C) may be set to be further lower than that of the previous step (e.g., 1,000 V). In this way, the voltages may be adequately selected.

Embodiment 2

The embodiment is configured in a substantially same manner as Embodiment 1, and is different from Embodiment 1 in that the developing bias setting unit 51 of FIG. 3 operates so that the alternating voltages of the developing biases of the developers 24*a* to 24*d* have a constant peak-to-peak voltage Vpp and their duty ratios (corresponding to "T1/T0" in FIG. 4) are sequentially reduced in accordance with the development order.

Figure 7:
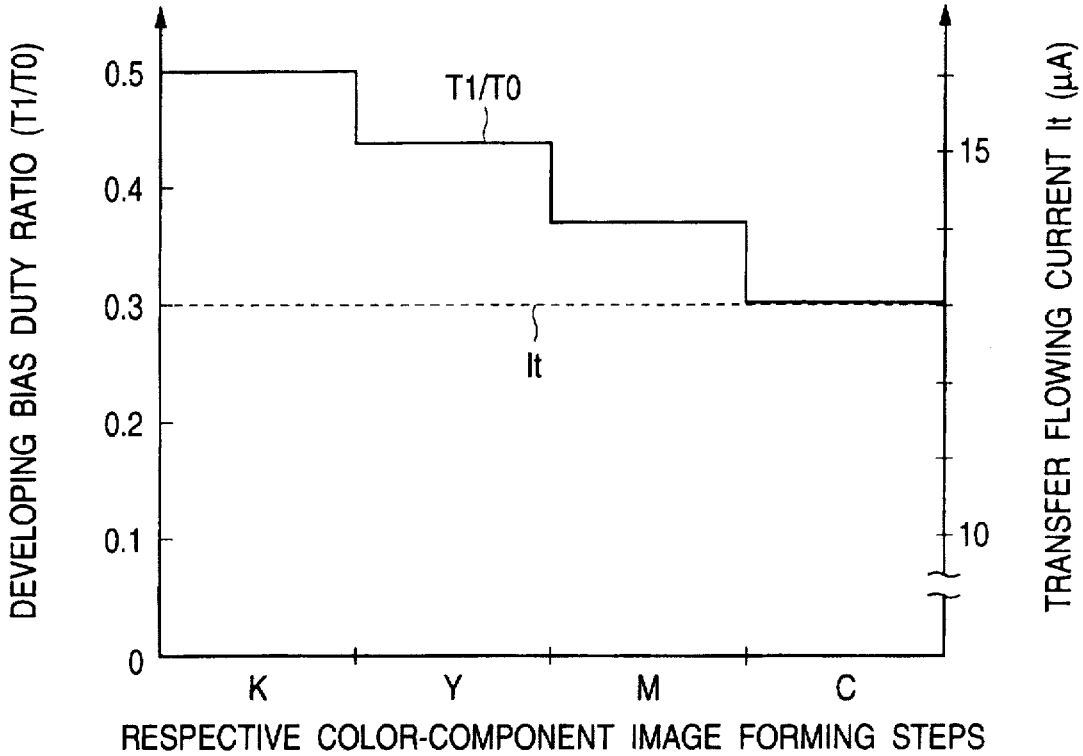
FIG. 7 is a diagram schematically showing the image forming process in Embodiment 2.

The image forming process is conducted in the same manner as Embodiment 1. FIG. 7 shows the states of the duty ratios of the developing biases and the transfer flowing current It in the respective color-component image forming steps in the image forming process.

As a specific example of the embodiment, images were formed in the following manner. The peak-to-peak voltages Vpp of the developing biases of the developers 24*a* to 24*d* were fixed to 1,500 V, and their duty ratios were sequentially reduced as 0.5 (K), 0.43 (Y), 0.37 (M), and 0.3 (C), in accordance with the development order of (K (black)→Y (yellow)→M (magenta)→C (cyan)). As a result, it was confirmed that, as compared with the case where the peak-to-peak voltages Vpp of the developing biases are fixed to 1,500 V and the duty ratios are fixed to 0.5, a character peripheral void hardly occurs even when a character is transferred and the background is then transferred.

Other conditions of the embodiment are the same as those of Embodiment 1.

Also in the embodiment, in the same manner as Embodiment 1, the duty ratio of the alternating voltage of at least one developing step may be set to be lower than that of the previous step in accordance with the development order, as far as it is in the range where the transfer performance can be maintained.

Embodiment 3

The embodiment is configured in the substantially same manner as Embodiment 1, and is different from Embodiment 1 in that the transfer flowing current setting unit 61 of FIG. 3 gradually increases the transfer flowing current It of the transfer charger 254 in accordance with the transfer order.

Figure 8:
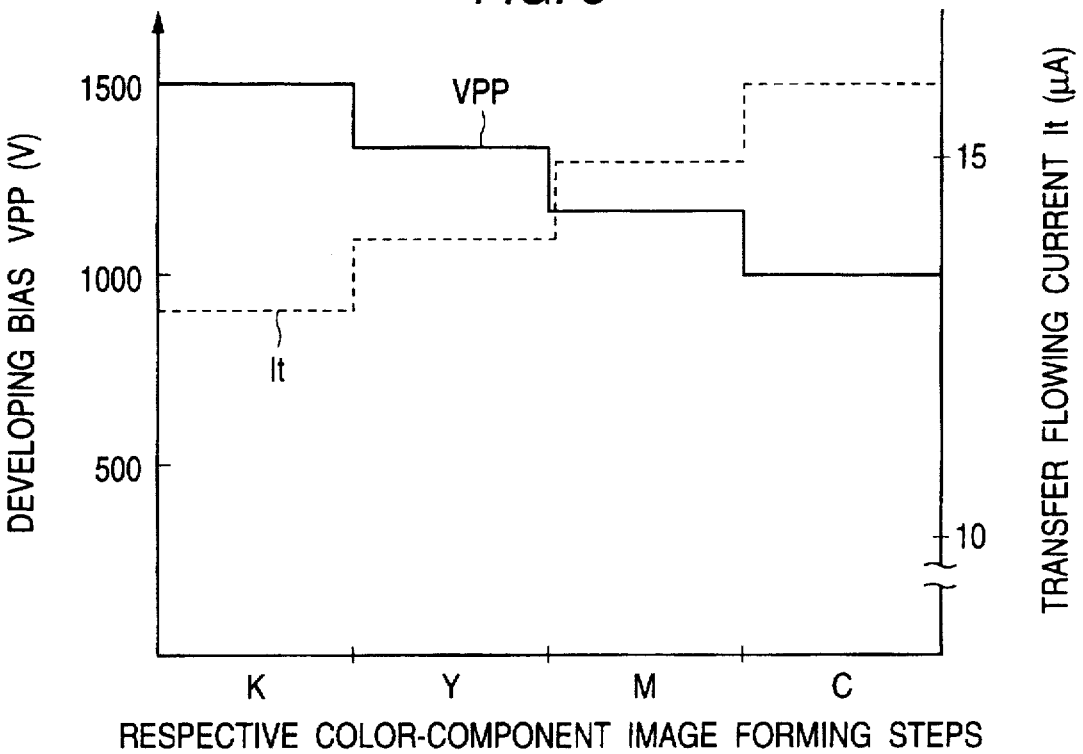
FIG. 8 is a diagram schematically showing the image forming process in Embodiment 3.

The image forming process is conducted in the same manner as Embodiment 1. FIG. 8 shows the states of the peak-to-peak voltages Vpp of the developing biases and the transfer flowing current It in the respective color-component image forming steps.in the image forming process.

As a specific example of the embodiment, images were formed in the following manner. The peak-to-peak voltages Vpp of the alternating voltages of the developers 24*a* to 24*d* were sequentially lowered as 1,500 V (K), 1,350 V (Y), 1,200 V (M), and 1,000 V (C), in accordance with the development order of (K (black)→Y (yellow)→M (magenta)→C (cyan)), and the transfer flowing current It of the transfer charger 254 was gradually increased as 13 μA (K), 14 μA (Y), 15 μA (M), and 16 μA (C), in accordance with the transfer order of (K (black)→Y(yellow)→M (magenta)→C (cyan)). As a result, it was confirmed that, as compared with Embodiment 1, a character peripheral void is prevented more surely from occurring even when a character is transferred and the background is then transferred.

In the embodiment, the peak-to-peak voltages Vpp of the alternating voltages of the developers 24*a* to 24*d* are sequentially lowered in accordance with the development order, and the transfer flowing current It of the transfer charger 254 is gradually increased in accordance with the transfer order. The invention is not restricted to this. The peak-to-peak voltage Vpp of at least one developing step may be set to be lower than that of the previous step in accordance with the development order, or the transfer flowing current It of at least one transferring step may be set to be higher than that of the previous step in accordance with the transfer order, as far as it is in the range where the transfer performance can be maintained.

In the embodiment, the object of the reduction is the peak-to-peak voltage Vpp of the alternating voltage. It is a matter of course that, in place of the peak-to-peak voltage Vpp, the duty ratio of the alternating voltage may be employed as the object of the reduction.

Embodiment 4

In a high-humidity environment, generally, water contained in a transfer material causes the transfer electric field to spread, so that the electric field is formed also in the transfer prenip region, with the result that the transfer electric field acts also on a portion where a gap is formed between the transfer material and the latent image carrier. Consequently, an image defect such as a character peripheral void tends to be emphasized.

Figure 9:
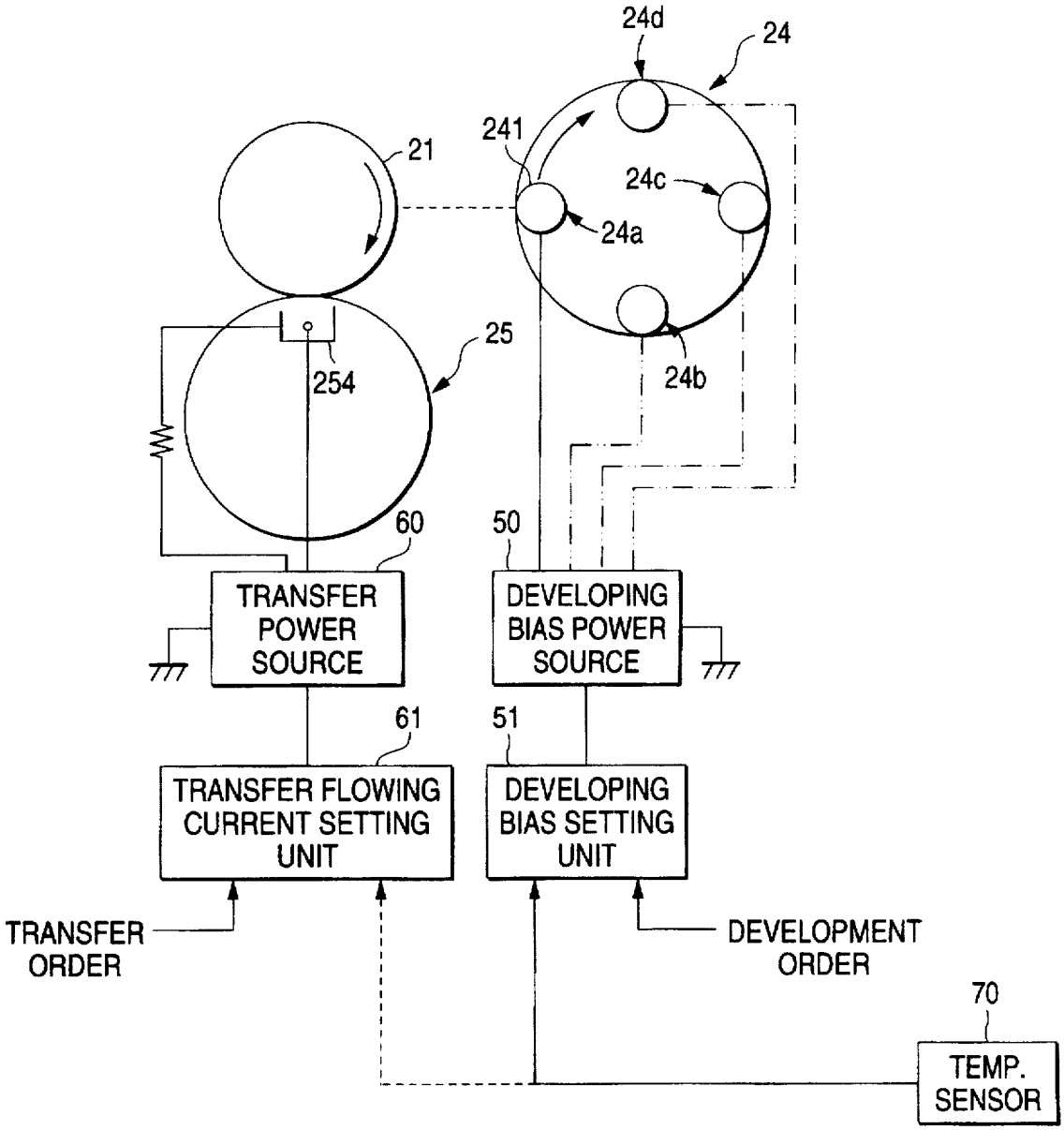
FIG. 9 is a diagram illustrating the main portions of image forming apparatuses of Embodiments 4 to 7.

The embodiment is very effective in solving the above-mentioned technical problem. The embodiment is configured in a substantially same-manner as Embodiment 1, and is different from Embodiment 1 in that, as shown in FIG. 9, the developing bias setting unit 51 operates so as to sequentially reduce the peak-to-peak voltages Vpp of the alternating voltages of the developing biases of the developers 24*a* to 24*d* in accordance with the development order, and correct the peak-to-peak voltages Vpp on the basis of humidity information (R.H.) from a humidity sensor 70 disposed in the apparatus.

Figure 10:
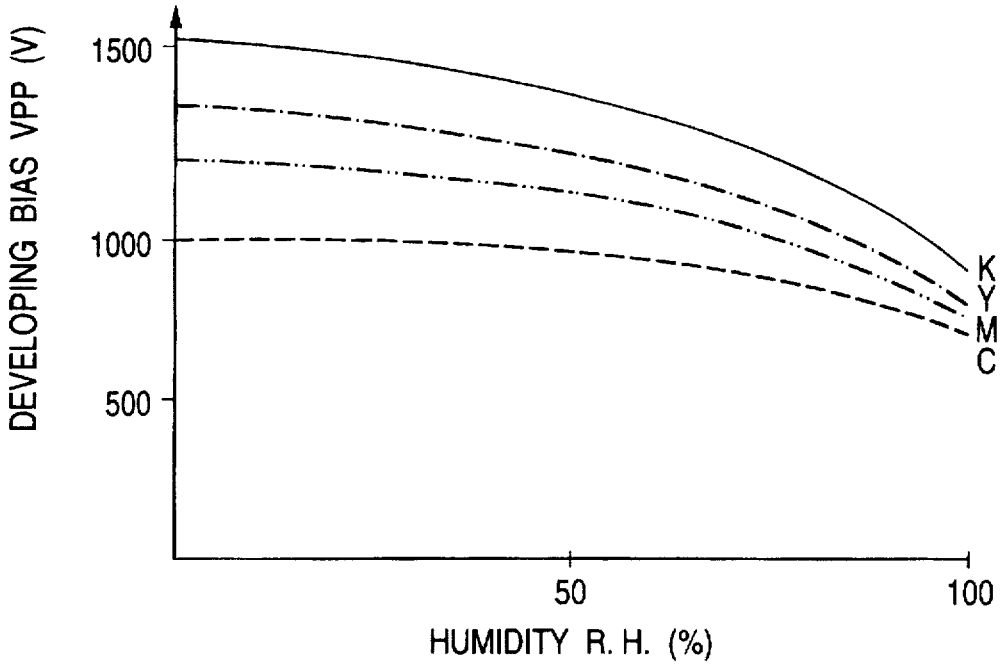
FIG. 10 is a graph showing relationships between the humidity and the developing bias in Embodiment 4.

FIG. 10 shows relationships between the humidity R.H. (%) and Vpp (V) of the developing bias.

In the embodiment, in a high-humidity environment, the peak-to-peak voltage Vpp of the alternating voltage of the developing bias is made lower than that in a normal environment as shown in FIG. 10, thereby reducing the adhesive force acting between the latent image carrier and toner. As a result, an image defect such as a character peripheral void can be effectively prevented from occurring.

Embodiment 5

The embodiment is configured in a substantially same manner as Embodiment 1, and is different from Embodiment 1 in that, as shown in FIG. 9, the transfer flowing current setting unit 61 operates so as to gradually increase the transfer flowing current It of the transfer charger 254 in accordance with the transfer order, and correct the transfer flowing current It on the basis of humidity information (R.H.) from the humidity sensor 70 disposed in the apparatus.

Figure 11:
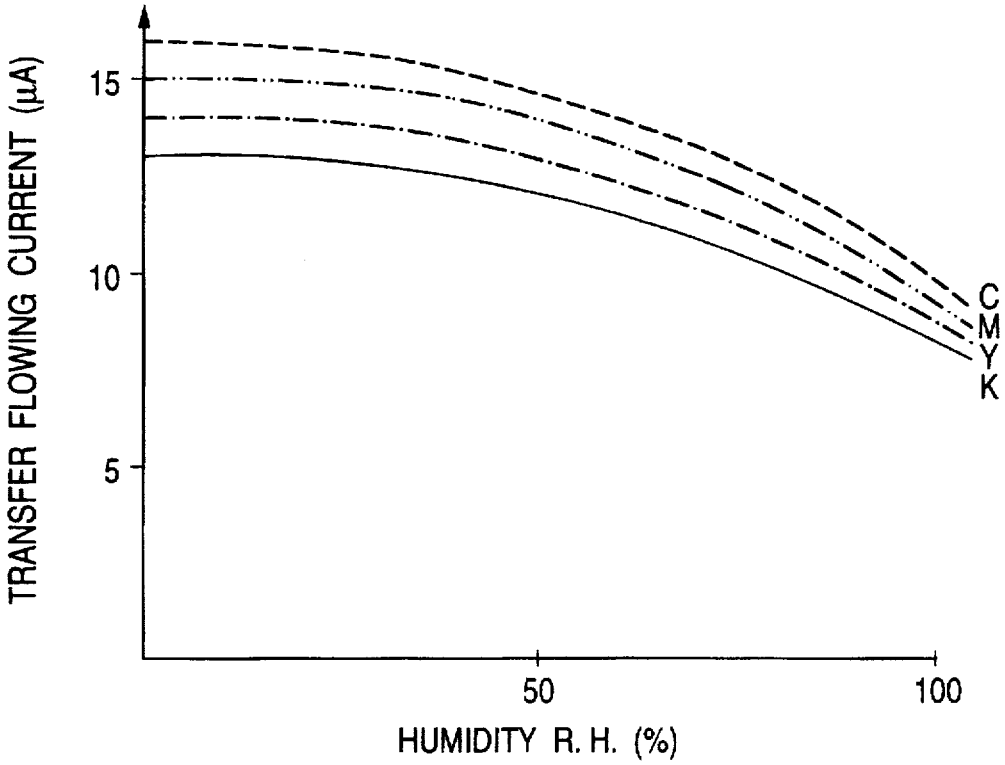
FIG. 11 is a graph showing relationships between the humidity and the developing bias in Embodiment 5.

FIG. 11 shows relationships between the humidity R.H. (%) and the transfer flowing current It (μA).

In the embodiment, in a high-humidity environment, the transfer flowing current It is made lower in level than that in a normal environment as shown in FIG. 11. Even when a water-contained low-resistivity paper sheet is used, therefore, the degree of spread of the electric field toward the transfer region (toward a prenip) is small. As a result, an image defect such as a character peripheral void can be effectively prevented from occurring.

Embodiment 6

The embodiment is a combination of Embodiments 4 and 5. As shown in FIG. 9, the developing bias setting unit 51 operates so as to sequentially reduce the peak-to-peak voltages Vpp of the alternating voltages of the developing biases of the developers 24*a* to 24*d* in accordance with the development order, and correct the peak-to-peak voltages Vpp on the basis of humidity information (R.H.) from the humidity sensor 70 disposed in the apparatus (see FIG. 10). On the other hand, as shown in FIG. 9, the transfer flowing current setting unit 61 operates so as to gradually increase the transfer flowing current It of the transfer charger 254 in accordance with the transfer order, and correct the peak-to-peak voltages Vpp on the basis of humidity information (R.H.) from the humidity sensor 70 disposed in the apparatus (see FIG. 11).

The embodiment can more surely cope with a change of the humidity environment than Embodiments 4 and 5.

Figure 13:
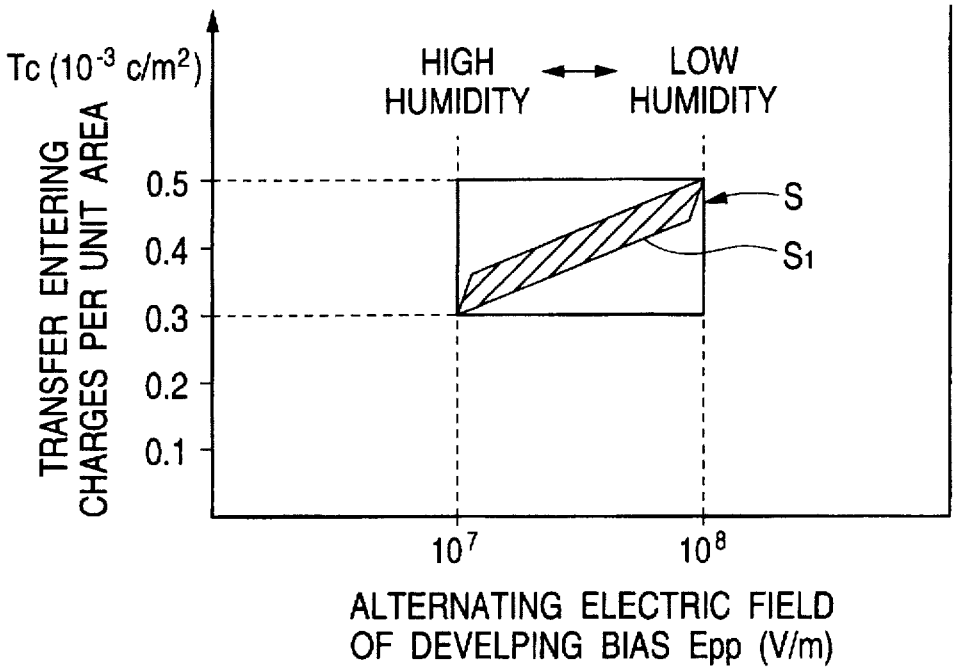
FIG. 13 is a diagram illustrating the usable range of the alternating electric field of the developing bias and transfer entering charges per unit area in Embodiment 6.

In order to confirm the above, relationships between the alternating electric field of the developing bias effective to an environmental change (between low humidity and high humidity) due to humidity, and transfer entering charges Tc per unit area ($10^{-3}C/m^2$) of the transfer charger were investigated. As a result, it was confirmed that, as shown in FIG. 13, the hatched region S1 of the rectangular region S functions as a satisfactory use range.

Figure 12A:
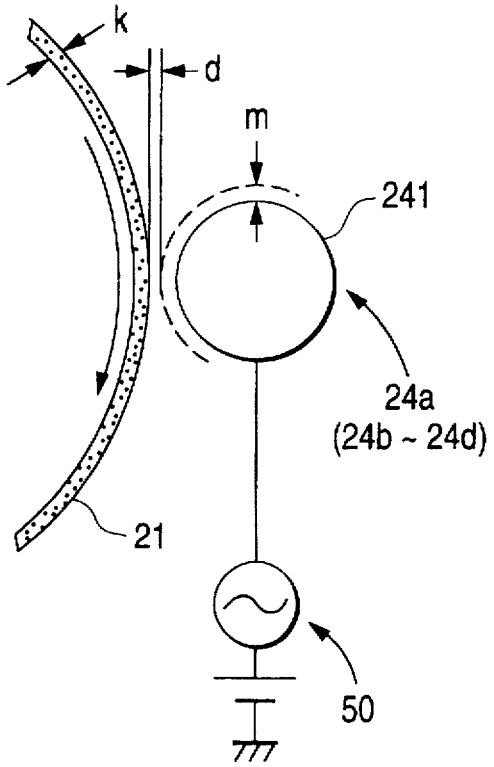
FIG. 12A is a diagram showing the configuration of the periphery of the developer.
Figure 12B:
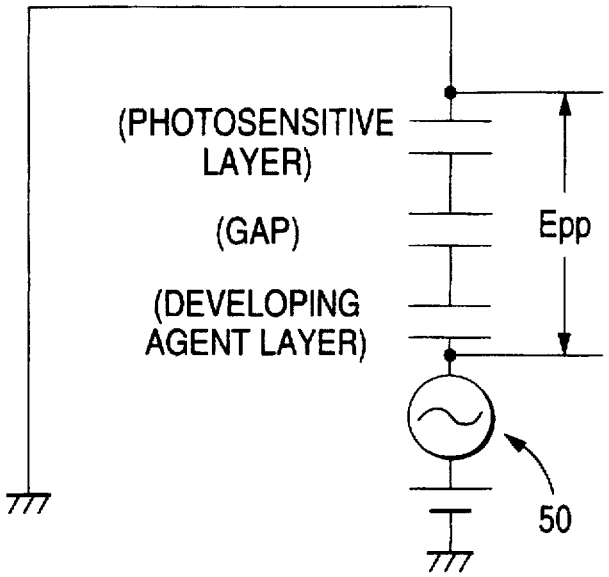
FIG. 12B is a diagram equivalently showing the alternating electric field.

As shown in FIG. 12A, the thickness of the photosensitive layer of the latent image carrier 21 is indicated by k, the gap (Gap) between the latent image carrier 21 and the developing agent on the developing roll 241 of the developer 24*a* (or 24*b*, 24*c*, or 24*d*) is indicated by d, and the thickness of the layer of the developing agent is indicated by m. The alternating electric field Epp shown in FIG. 13 is the alternating electric field of the developing bias formed across a capacitive layer consisting of the photosensitive layer of the latent image carrier 21, the gap (Gap), and the developing agent layer as shown in an equivalent circuit diagram of FIG. 12B. In an example case where k=30 μm (ε (specific dielectric constant)=3), d=50 μm (ε=1), and m=500 μm (ε=15 to 30), when the alternating electric field Epp is calculated while setting the peak-to-peak voltage Vpp of the alternating electric field of the developing bias to be 1,500 V, the calculation result shows that Epp=about $1.6\times10^7$ to $2.0\times10^7$ (V/m). The transfer entering charges Tc per unit area ($10^{-3}C/m^2$) of the transfer charger can be obtained by dividing the transfer flowing current by the process speed of the latent image carrier.

Embodiment 7

The embodiment is configured in a substantially same manner as Embodiment 6, and shows the optimum example of the case where the peak-to-peak voltage Vpp of the alternating electric field of the developing bias and the transfer flowing current It are controlled in accordance with the environment.

Figure 14:
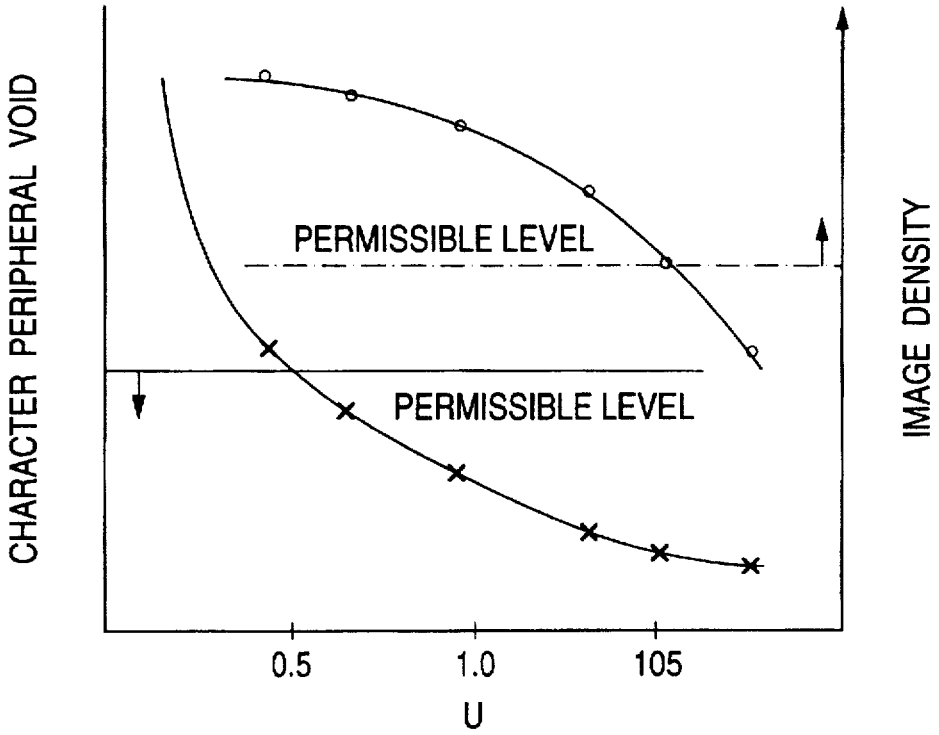
FIG. 14 is a graph showing relationships between a parameter U and a character periphery void and the image density in an image forming apparatus of Embodiment 7.

An alternating electric field strength (corresponding to the peak-to-peak voltage) at a high humidity is indicated by Vpp(High Hum), an alternating electric field strength at a low humidity is indicated by Vpp(Low Hum), a transfer flowing current at a high humidity is indicated by It(High Hum), and a transfer flowing current at a low humidity is indicated by It(Low Hum). In the embodiment, It(High Hum) was set to be 8 μA, It(Low Hum) was set to be 16 μA, and Vpp(Low Hum) was set to be 1,500 V, and Vpp(High Hum) was suitably changed. Under this situation, a character peripheral void and the image density were investigated with using U={It(High Hum)/It(Low Hum)}·{Vpp(Low Hum)/Vpp(High Hum)} as a parameter. The results shown in FIG. 14 were obtained.

In the figure, the allowable level of a character peripheral void means a degree at which a character peripheral void cannot be visually recognized with respect to a boundary sample, and that of the image density means a level at which a predetermined reference density (optical density of 1.5) or more is obtained.

From the figure, it will be seen that the results shows there arises no problem in character peripheral void and image density in the range of $0.5<U<1.5$.

Embodiment 8

Figure 15:
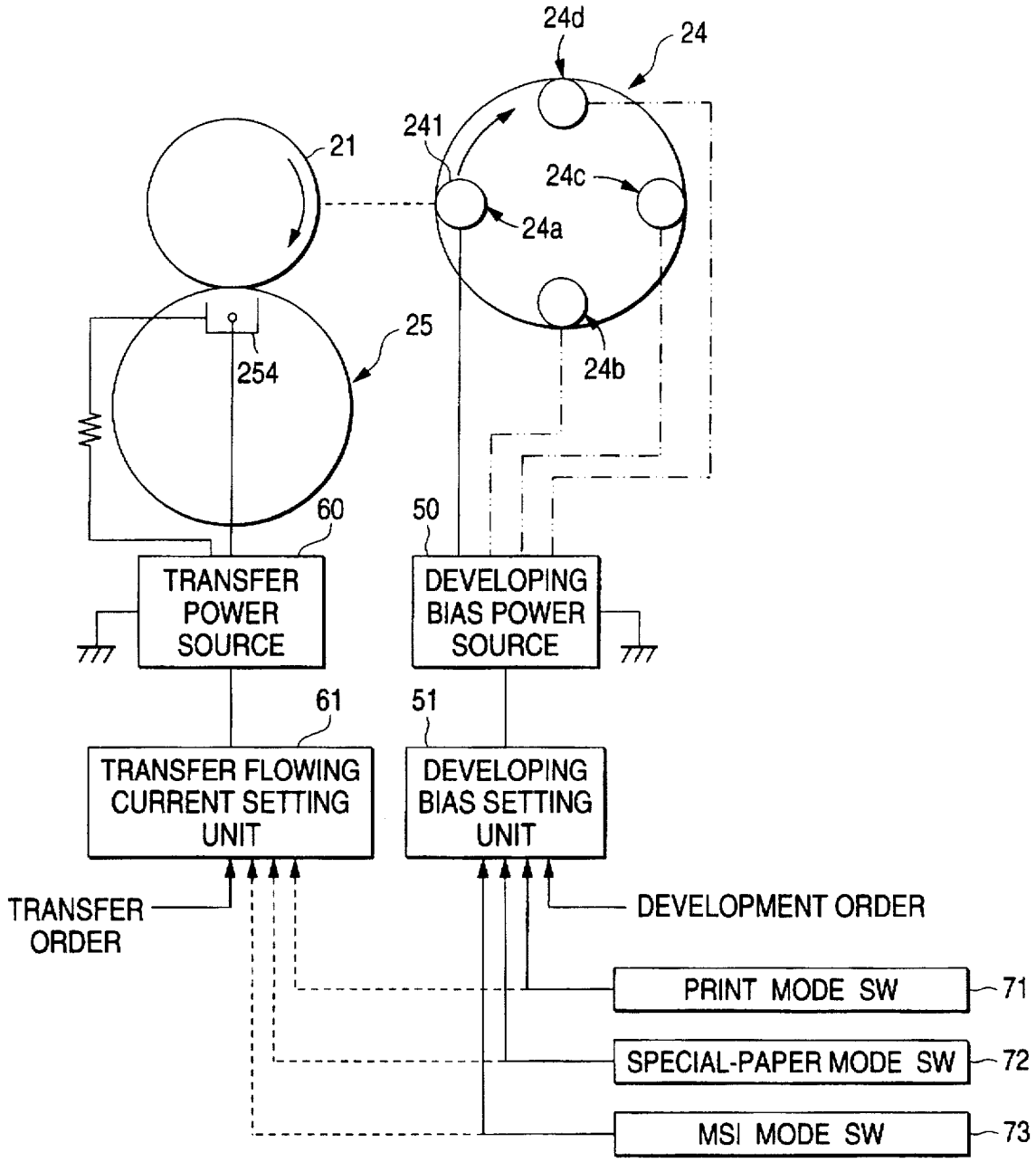
FIG. 15 is a diagram illustrating the main portions of image forming apparatuses of Embodiments 8 to 13.
Figure 16:
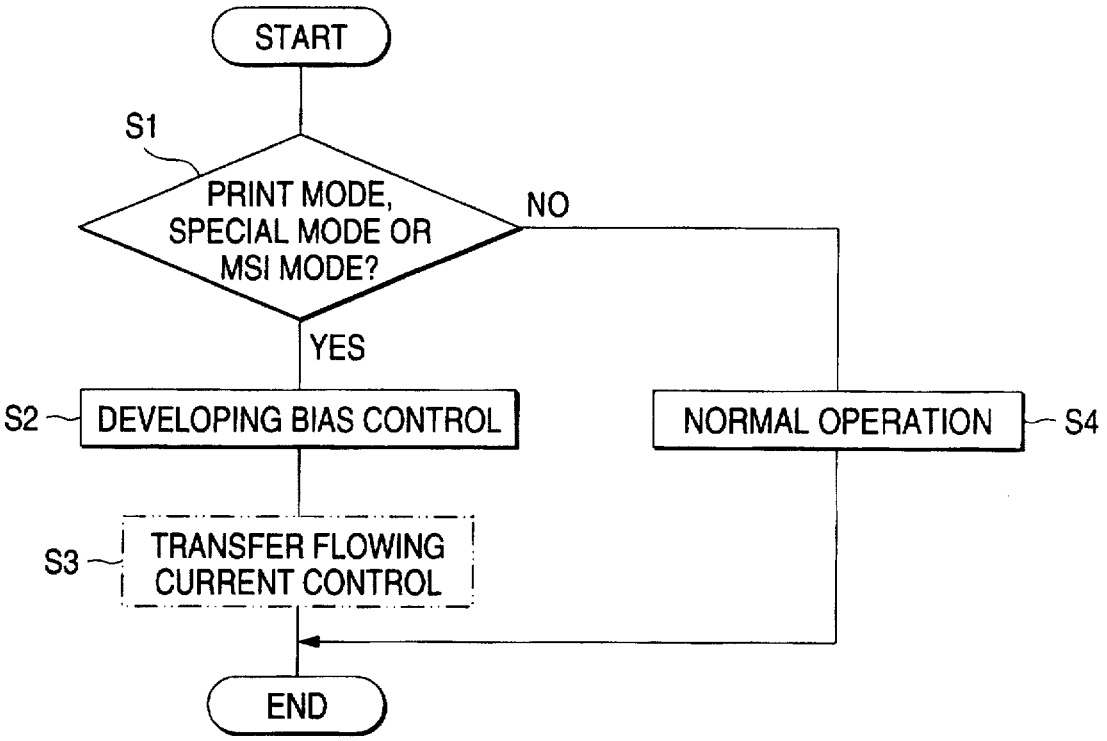
FIG. 16 is a flowchart showing the control process of the image forming apparatuses of Embodiments 8 to 13.

The embodiment is configured so as to be selectively switched over from the copy mode to the print mode or vice versa, and in a substantially same manner as Embodiment 1. As shown in FIGS. 15 and 16, however, the developing bias setting unit 51 operates so as to, when a print mode switch 71 is turned on (the print mode is selected in step S of FIG. 16), conduct a developing bias control (Step S2) which is different from that of the normal operation (Step S4), thereby setting the peak-to-peak voltage Vpp of the alternating voltage to be lower than that in the copy mode.

In the print mode, generally, the possiblity that a signal which is not subjected to-the image processing is output to become a signal of a higher coverage for the colors is high. As compared with the copy mode, therefore, the height of the toner pile is easily increased, whereby a transfer failure is easily produced.

By contrast, in the embodiment, the peak-to-peak voltage Vpp of the alternating voltage is further lowered in the print mode, and hence an image defect such as a character peripheral void due to a transfer failure can be effectively prevented from occurring.

The embodiment may be configured on the basis of Embodiment 2 in place of Embodiment 1.

Embodiment 9

The embodiment is configured so as to be selectively switched over from the copy mode to the print mode or vice versa, and in a substantially same manner as Embodiment 3. As shown in FIGS. 15 and 16, unlike Embodiment 3, the developing bias setting unit 51 and the transfer flowing current setting unit 61 operate so as to, when the print mode switch 71 is turned on (the print mode is selected in Step S1 of FIG. 16), conduct a developing bias control (Step S2) and the transfer flowing current control (Step S3) which are different from those of the normal operation (Step S4), thereby lowering the peak-to-peak voltage Vpp of the alternating voltage as compared with the case of the copy mode and increasing the transfer flowing current.

According to the embodiment, a character peripheral void in the print mode can be prevented more surely from occurring than Embodiment 8.

Embodiment 10

The embodiment is configured in a substantially same manner as Embodiment 1. As shown in FIGS. 15 and 16, unlike Embodiment 1, a developing bias control which is different from that of the normal operation is conducted when a special paper mode switch 72 is turned on (Step S1), thereby lowering the peak-to-peak voltage Vpp of the alternating voltage.

The special paper mode switch 72 is a switch to be operated when a paper sheet in which fibers are not dense (or coarse) is used.

In the case where a paper sheet having a structure in which fibers are coarse is used as a transfer material, generally, even when the transfer electric field is applied and a uniform electric field acts, the distribution of the electric field strength on the basis of the fiber density structure of the sheet is generated and an image void in the periphery of a character is promoted.

In the embodiment, the special paper mode switch 72 is turned on when a paper sheet in which fibers are not dense is used, so that the peak-to-peak voltage Vpp of the alternating voltage is lowered. Therefore, an image defect such as a character peripheral void due-to a transfer failure can be effectively prevented from occurring.

The embodiment may be configured on the basis of Embodiment 2 in place of Embodiment 1.

Embodiment 11

The embodiment is configured in a substantially same manner as Embodiment 3. As shown in FIGS. 15 and 16, unlike Embodiment 3, the developing bias setting unit 51 and the transfer flowing current setting unit 61 operate so as to, when the special paper mode switch 72 is turned on, conduct a developing bias control (Step S2) and the transfer flowing current control (Step S3) which are different from those of the normal operation, thereby lowering the peak-to-peak voltage Vpp of the alternating voltage and increasing the transfer flowing current as compared with the case of the copy mode.

According to the embodiment, a character peripheral void in the special paper mode can be prevented more surely from occurring than Embodiment 10.

Embodiment 12

The embodiment is configured in a substantially same manner as Embodiment 1. As shown in FIGS. 15 and 16, unlike Embodiment 1, when a manual sheet insertion (MSI) mode switch 73 is turned on (an MSI mode is selected in Step S1 of FIG. 16), a developing bias control which is different from that of the normal operation is conducted (Step S2) so as to lower the peak-to-peak voltage Vpp of the alternating voltage.

The MSI mode switch 73 is a switch to be turned on when the manual feed mode is selected.

In the case where a system in which a sheet supply tray has a heater is employed, generally, the water content of paper sheets in the sheet supply tray can be adjusted even at a high humidity. However, a manual supply tray (MSI tray) is not provided with a heater. In the case where a manual supply tray is used, situations in which sheets have a higher water content often happen at a high humidity.

To comply with this, in the embodiment, the MSI mode switch 73 is turned on in the MSI mode so that the peak-to-peak voltage Vpp of the alternating voltage is lowered. Therefore, an image defect such as a character peripheral void due to a transfer failure can be effectively prevented from occurring.

The embodiment may be configured on the basis of Embodiment 2 in place of Embodiment 1.

Embodiment 13

The embodiment is configured in a substantially same manner as Embodiment 3. As shown in FIGS. 15 and 16, unlike Embodiment 3, the developing bias setting unit 51 and the transfer flowing current setting unit 61 operate so as to, when the MSI mode switch 73 is turned on (the MSI mode is selected in Step S1 of FIG. 16), conduct a developing bias control (Step S2) and the transfer flowing current control (Step S3) which are different from those of the normal operation, thereby lowering the peak-to-peak voltage Vpp of the alternating voltage and increasing the transfer flowing current as compared with the case of the copy mode.

According to the embodiment, a character peripheral void in the MSI mode can be prevented more surely from occurring than Embodiment 12.

Embodiment 14

Figure 17:
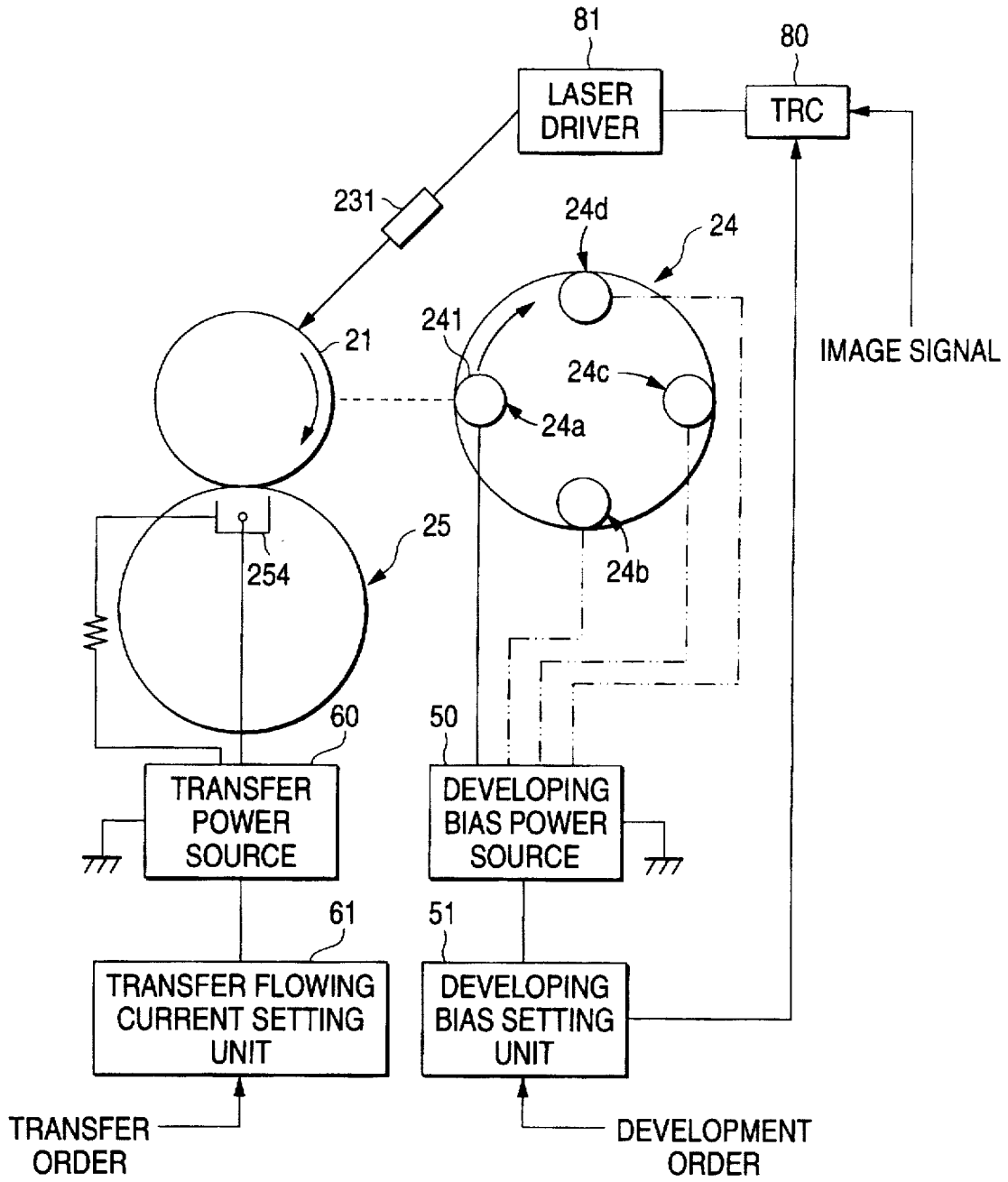
FIG. 17 is a diagram illustrating the main portions of an image forming apparatus of Embodiment 14.

The embodiment is configured in a substantially same manner as Embodiment 17 and the transfer flowing current setting unit 61 operates so as to gradually lower the peak-to-peak voltage Vpp of the alternating voltage in accordance with the development order. As shown in FIG. 17, unlike Embodiment 1, when the peak-to-peak voltage Vpp of the alternating voltage of the developing bias is changed by the developing bias setting unit 51, a signal indicative of the change is supplied to a tone reproduction controller (TRC) 80.

The TRC 80 controls the output density with respect to the input density and supplies an output density signal to a laser driver 81, thereby controlling a laser device 231 of the laser exposure 23 (see FIG. 2).

Figure 18A:
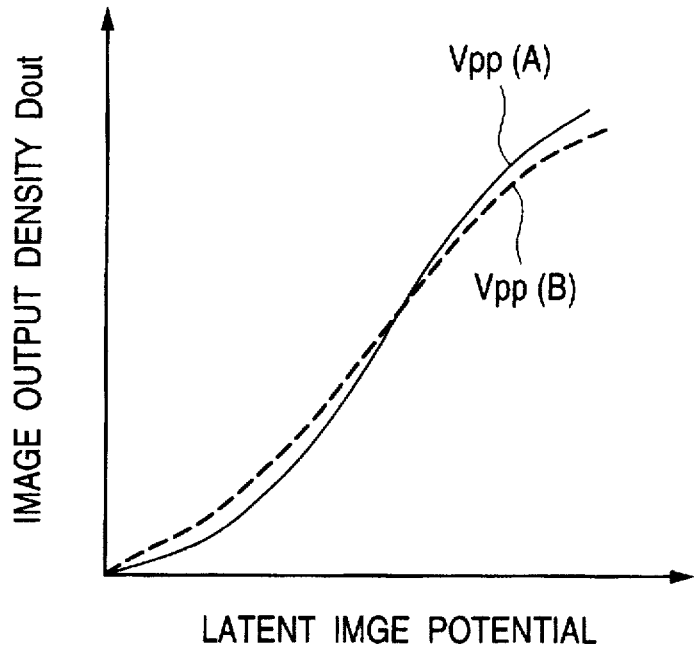
FIG. 18A is a graph showing the state of a change of the image output density with- respect to the latent image potential due to a change of the peak-to-peak voltage Vpp of the alternating voltage.

When the peak-to-peak voltage Vpp of the alternating voltage is changed, for example, from Vpp(A) (1,500 V) to Vpp(B) (1,000 V), generally, the image output density Dout with respect to the latent image potential particularly the gray scale in a highlight portion (low-density portion) is changed as shown in FIG. 18A.

Figure 18B:
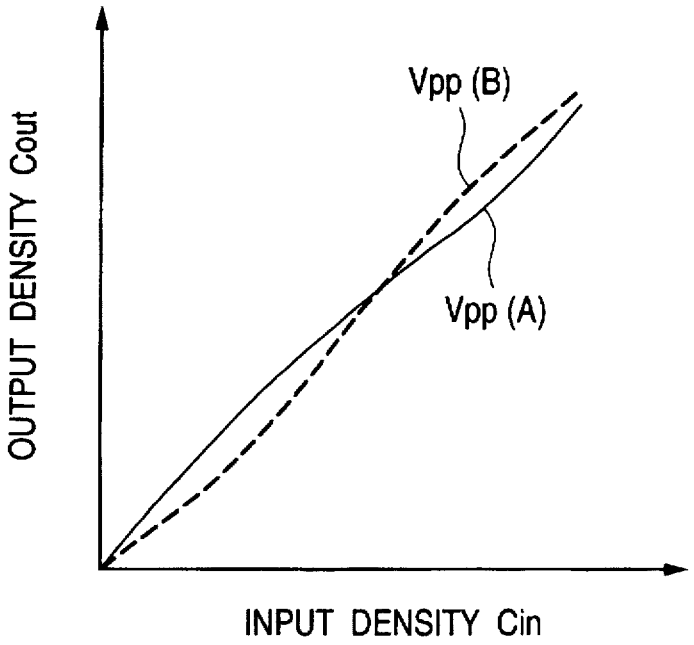
FIG. 18B is a diagram showing the state of a change of the output density with respect to the input density of the TRC due to a change of the peak-to-peak voltage Vpp of the alternating voltage.

To comply with this, in the embodiment, the change signal of the peak-to-peak voltage Vpp of the alternating voltage is supplied to the TRC 80, whereby, as shown in FIG. 18B, the curve of the output density Cout of the TRC 80 with respect to the input density Cin is changed from that indicated by the solid line to that indicated by the broken line. Even when the peak-to-peak voltage Vpp of the alternating voltage is changed, therefore, the image output density Dout with respect to the input density Cin is controlled so as to be constant.

According to the embodiment, even when the peak-to-peak voltage Vpp of the alternating voltage is changed, the gray scale of the image can be maintained to be constant and the color balance of a color image can be satisfactorily held.

Embodiment 15

Figure 19:
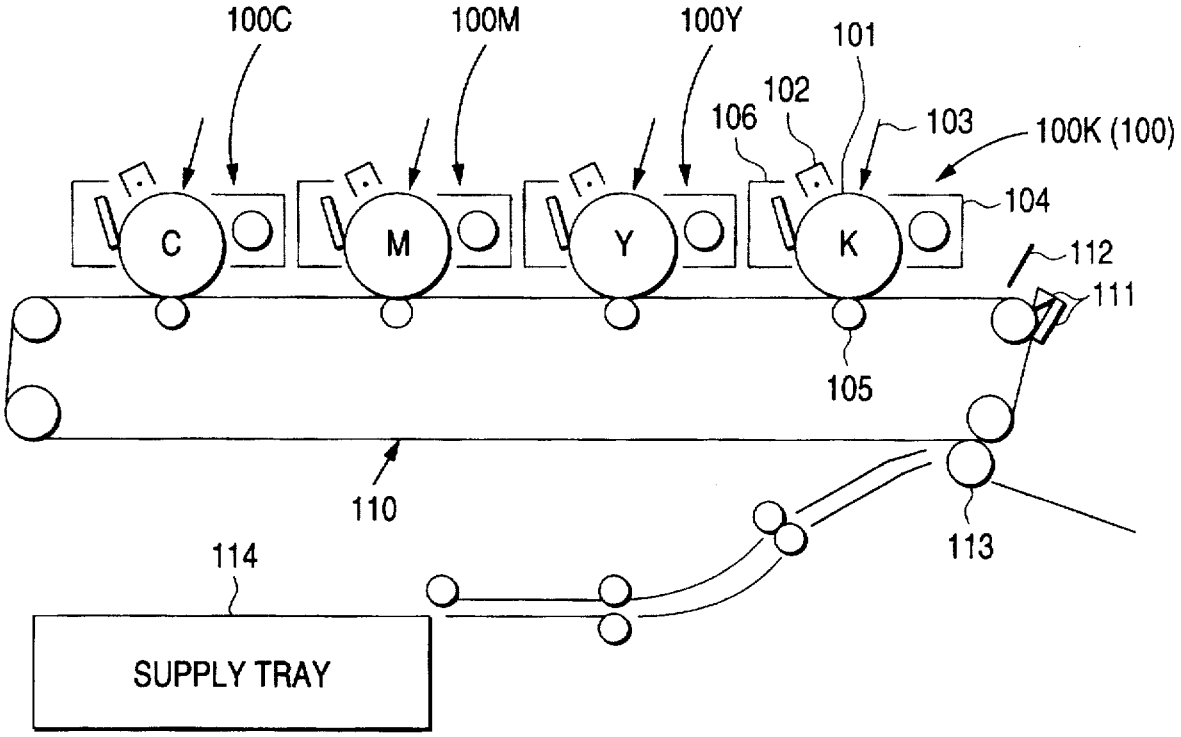
FIG. 19 is a diagram illustrating the main portions of an image forming apparatus of Embodiment 15.
Figure 20:
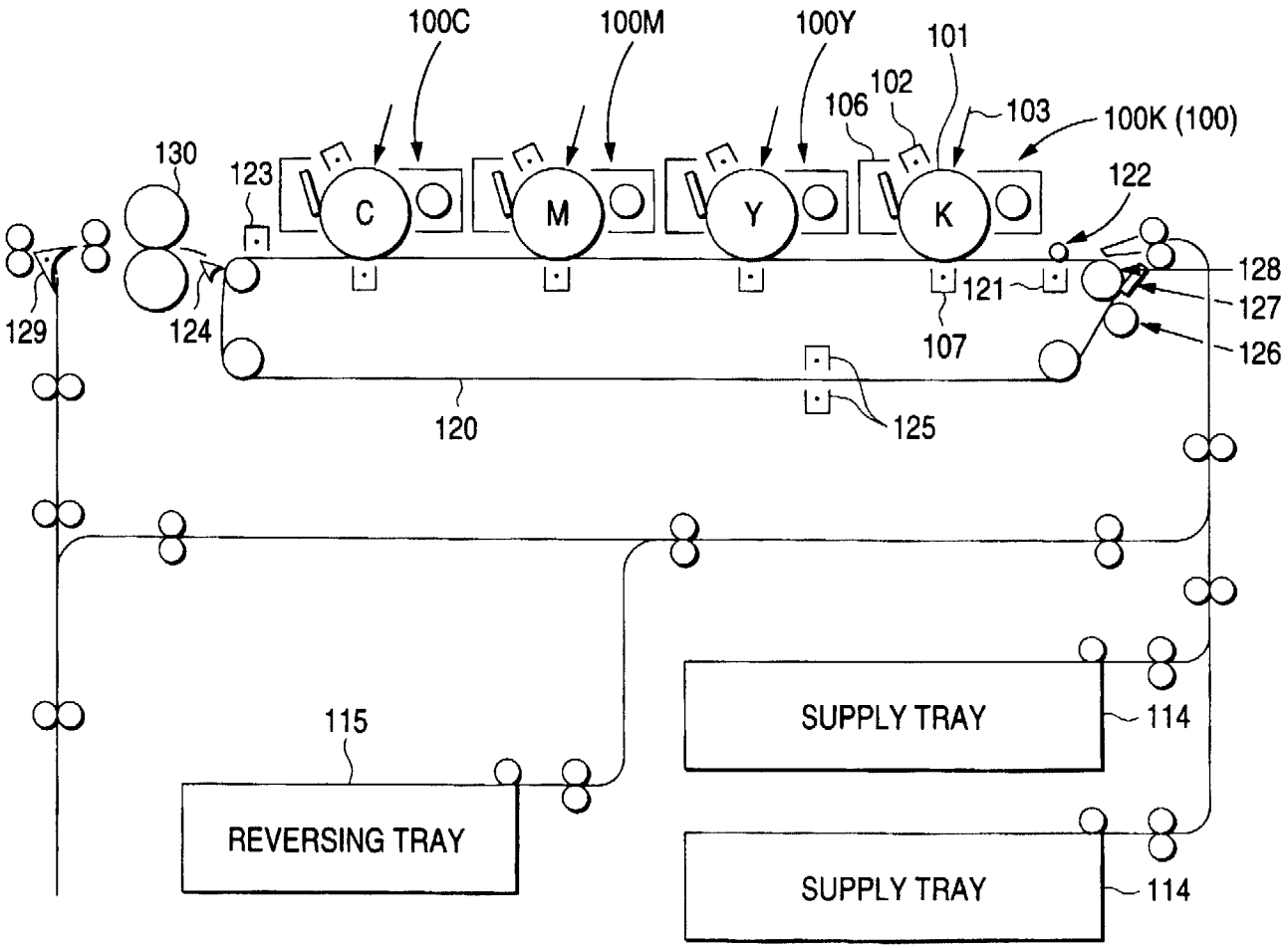
FIG. 20 is a diagram illustrating the main portions of an image forming apparatus of Embodiment 16.

FIG. 19 shows Embodiment 15 of a color image forming apparatus to which the invention is applied.

Referring to the figure, unlike Embodiment 1, the color image forming apparatus of the embodiment comprises plural image forming units 100 (specifically, 100K, 10Y, 100M, and 100C) in which color-component toner images are respectively formed by, for example, the electrophotographic system and which are arranged in parallel. The color-component toner images formed by the respective image forming units 100 are sequentially primary-transferred to an intermediate transfer belt 110, and the color-component images on the intermediate transfer belt 110 are secondary-transferred by a secondary-transfer roll 113 to a transfer material (not shown) supplied from a supply tray 114. In In the embodiment, each of the image forming units 100 for the respective color components comprises electrophotographic devices which are sequentially arranged around a latent image carrier 101 such as a photosensitive drum. Such electrophotographic devices include: a uniform charger 102 which charges the latent image carrier 101; a laser exposure 103 which draws an electrostatic latent image on the latent image carrier 101 (in the figure, only a beam is shown); a developer 104 which contains toner of a corresponding color component and visualizes the electrostatic latent image on the latent image carrier 101; a primary-transfer roll 105 which transfers the color-component toner image on the latent image carrier 101 to the intermediate transfer belt 110; and a cleaner 106 which removes away residual toner and the like on the latent image carrier 101.

The reference numeral 111 designates a belt cleaner which removes away residual toner and the like on the intermediate transfer belt 110, and 112 designates a discharger which eliminates residual charges of the intermediate transfer belt 110.

In the embodiment, particularly, the developer 104 of each of the image forming units 100 applies a developing bias on which an alternating voltage is superimposed, to a developing roll, and a developing bias setting unit which is not shown adjusts the peak-to-peak voltages or the duty ratios of the alternating voltages so as to be sequentially reduced in accordance with, for example, the development order.

In the embodiment, the transferring bias of a predetermined level is applied to the primary-transfer roll 105 of each of the image forming units 100, and a transferring bias setting unit which- is not shown gradually increases the transferring bias in accordance with, for example, the transfer order.

In the embodiment, therefore, toner images on the latent image carriers 101 of the image forming units 100 are sequentially transferred to the intermediate transfer belt 110, and then collectively transferred to a transfer material.

It was confirmed that, even when a character is transferred and the background is then transferred in such an image forming process, it is possible to obtain an excellent color image in which a character peripheral void hardly occurs.

It is a matter of course that the embodiment may be adequately modified with respect to, for example, the manner of setting the transferring bias constant and various improvements described in Embodiments 1 to 14 may be suitably applied to the embodiment.

Embodiment 16

FIG. 2 shows Embodiment of a color image forming apparatus to which the invention is applied.

Referring to the figure, unlike Embodiment 1, the color image forming apparatus of the embodiment comprises plural image forming units 100 (specifically, 100K, 10Y, 100M, and 100C) in which color-component toner images are respectively formed by, for example, the electrophotographic system and which are arranged in parallel. The color-component toner images formed by the respective image forming units 100 are sequentially transferred to a transfer material (not shown) on a transport belt 120.

Each of the image forming units 100 used in the embodiment comprises electrophotographic devices such as the latent image carrier 101; the uniform charger 102, the laser exposure 103 (in the figure, only a beam is shown), the developer 104, a transfer charger 107 such as a corotron, and the cleaner 106.

The transfer material is sent to a supply station of the transport belt 120 through the supply tray 114 or a reversing tray 115 through a predetermined path, and then transported while being electrostatically sucked to the transport belt 120 by a suction device consisting of, for example, a corotron 121 and a suction roll 122. The transfer material is separated from the transport belt 120 by a separation device consisting of, for example, a corotron 123 and separation fingers 124, and then transported to a fixing device 130.

The reference numeral 125 designates a discharger which discharges the transport belt 1-20, 126 to 128 designate brush cleaners and a blade cleaner which remove away paper dust and the like on the transport belt 120, and 129 designates a switch gate which selectively controls the transfer material that has passed through the fixing device 130, so as to be discharged as it is or to be guided to a two-sided process reversing unit (not shown).

In the embodiment, particularly, the developer 104 of each of the image forming units 100 applies the developing bias on which an alternating voltage is superimposed, to a developing roll, and a developing bias setting unit which is not shown adjusts the peak-to-peak voltages or the duty ratios of the alternating voltages so as to be sequentially reduced in accordance with, for example, the development order.

In the embodiment, the transfer flowing current of a predetermined level is supplied to the transfer charger 107 of each of the image forming units 100, and a transfer flowing current setting unit which is not shown gradually increases the transfer flowing current in accordance with, for example, the transfer order.

In the embodiment, therefore, toner images on the latent image carriers 101 of the image forming units 100 are sequentially transferred to the transfer material on the transport belt 120. After the transfer of the toner image of the final color is completed, the transfer material is separated from the transfer belt 120 and then guided to the fixing device 130.

It was confirmed that, even when a character is transferred and the background is then transferred in such an image forming process, it is possible to obtain an excellent color image in which a character peripheral void hardly occurs.

It is a matter of course that the embodiment may be adequately modified with respect to, for example, the manner of setting the transferring bias constant and various improvements described in Embodiments 1 to 14 may be suitably applied to the embodiment.

As described above, in an image forming apparatus comprising plural developing means, a degree of an action of the alternating electric field on at least one of the developing means which are later in development order is reduced to a level which is lower than that in a preceding step. With respect to a toner image of a color which is later in development order, therefore, the adhesive force of the toner image acting on the image carrier can be reduced and the toner image of the color can be held to the image carrier in a state wherein it can be easily transferred.

Even when a gap is formed between the transfer medium and the image carrier by the pile height of a toner image which is previously transferred to the transfer medium, therefore, the toner image on the image carrier is surely transferred to the transfer medium, thereby surely preventing an image defect such as a character peripheral void from occurring.

When at least one of the transferring means which are later in transfer order is configured so that a force of transfer to the transfer medium applied to a color-component toner image on the image carrier is increased to a level which is higher than that in the preceding step, the toner image on the image carrier is surely transferred to the transfer medium, thereby surely preventing an image defect such as a character peripheral void from occurring.

According to the invention, it is judged whether use conditions satisfy preset transfer failure conditions or not, and, when it is judged that the use conditions satisfy the transfer failure conditions, the alternating electric field changing means is caused to operate, or the alternating electric field changing means and the transfer force changing means are caused to operate. Therefore, a situation which may cause a transfer failure can be surely prevented from occurring.

According to the invention, the degree of a change of the alternating electric field conducted by the alternating electric field changing means is controlled in accordance with environmental conditions, or the degree of a change of the alternating electric field conducted by the alternating electric field changing means and that of a change of the transfer force conducted by the transfer force changing means are controlled. Therefore, it is possible to effectively avoid influence exerted by environmental conditions, such as that an image defect due to a transfer failure is easily caused by water contained in a transfer medium in a high-humidity environment.

According to the invention, in a type in which the alternating electric field strength and the transfer flowing current are controlled in accordance with environmental conditions, parameters are controlled in a range of $0.5<U<1.5$ where an alternating electric field strength at a high humidity is indicated by Vpp(High Hum), an alternating electric field strength at a low humidity is indicated by Vpp(Low Hum), a transfer flowing current at a high humidity is indicated by It(High Hum), a transfer flowing current at a low humidity is indicated by It(Low Hum), and $U=\{It(High\ Hum)/It(Low\ Hum)\}\cdot\{Vpp(Low\ Hum)/Vpp(High\ Hum)\}$. Therefore, an image defect such as a character peripheral void can be surely prevented from occurring, and the image density can be maintained to a satisfactory level.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

at least one image carrier;

latent image forming means for sequentially forming electrostatic latent images of color components on said image carrier;

a plurality of developing means arranged around said image carrier, for developing the electrostatic latent images on said image carrier by toner of respective color components under action of an alternating electric field generated by alternating electric field applying means;

transferring means for sequentially transferring color-component toner images formed on said image carrier to a transfer medium;

said alternating electric field applying means comprising alternating electric field changing means for reducing a degree of an action of the alternating electric field on at least one of said developing means which are later in development order, to a level which is lower than that in a preceding step; and operation condition judging means for whether use conditions, other than environmental conditions, satisfy preset transfer failure conditions or not, and for, when it is judged that the use conditions satisfy the transfer failure conditions, causing said alternating electric field changing means to operate.

2. An image forming apparatus according to claim 1, wherein at least one of said transferring means which are later in transfer order comprises transfer force changing means for increasing a force of transfer to said transfer medium applied to a color-component toner image on said image carrier, to a level which is higher than that in the preceding step.

3. An image forming apparatus according to claim 2, wherein said operation condition judging means, when it is judged that the use conditions satisfy the transfer failure conditions, causes said alternating electric field changing means and said transfer force changing means to operate.

4. An image forming apparatus according to claim 2, wherein said apparatus further comprises environmental condition adjusting means for, in accordance with environmental conditions, controlling a degree of a change of the alternating electric field conducted by said alternating electric field changing means, and a degree of a change of the transfer force conducted by said transfer force changing means.

5. An image forming apparatus according to claim 4, wherein said alternating electric field changing means changes a strength of the alternating electric field, said transfer force changing means changes a current flowing into said transfer medium; and wherein said environmental condition adjusting means controls parameters in a range of $0.5<U<1.5$ where an alternating electric field strength at a high humidity is indicated by Vpp(High Hum), an alternating electric field strength at a low humidity is indicated by Vpp(Low Hum), a transfer flowing current at a high humidity is indicated by It(High Hum), a transfer flowing current at a low humidity is indicated by It(Low Hum), and $U=\{It(High\ Hum)/It(Low\ Hum)\}\cdot\{Vpp(Low\ Hum)/Vpp(High\ Hum)\}$.

6. An image forming apparatus according to claim 1, wherein said apparatus further comprises environmental condition adjusting means for, in accordance with environmental conditions, controlling a degree of a change of the alternating electric field conducted by said alternating electric field changing means.

7. An image forming apparatus comprising:

at least one image carrier;

latent image forming means for sequentially forming electrostatic latent images of color components on said image carrier;

a plurality of developing means arranged around said image carrier, for developing the electrostatic latent images on said image carrier by toner of respective color components under action of an alternating electric field generated by alternating electric field applying means; and transferring means for sequentially transferring color-component toner images formed on said image carrier to a transfer medium, wherein said alternating electric field applying means comprises alternating electric field changing means for reducing a degree of an action of the alternating electric field on at least one of said developing means which are later in development order, to a level which is lower than that in a preceding step;

wherein at least one of said transferring means which are later in transfer order comprises transfer force changing means for increasing a force of transfer to said transfer medium applied to a color-component toner image on said image carrier, to a level which is higher than that in the preceding step;

wherein said alternating electric field changing means changes a strength of the alternating electric field, said transfer force changing means changes a current flowing into said transfer medium; and wherein a environmental condition adjusting means controls parameters in a range of $0.5<U<1.5$ where an alternating electric field strength at a high humidity is indicated by Vpp(High Hum), an alternating electric field strength at a low humidity is indicated by Vpp (Low Hum), a transfer flowing current at a high humidity is indicated by It(High Hum), a transfer flowing current at a low humidity is indicated by It(Low Hum), and $U=\{It(High\ Hum)/It(Low\ Hum)\}\cdot\{Vpp(Low\ Hum)Npp(High\ Hum)\}$.

8. An image forming apparatus according to claim 7, further comprising operation condition judging means for judging whether use conditions satisfy preset transfer failure conditions or not, and for, when it is judged that the use conditions satisfy the transfer failure conditions, causing said alternating electric field changing means to operate.

9. An image forming apparatus according to claim 7, wherein said apparatus further comprises environmental condition adjusting means for, in accordance with environmental conditions, controlling a degree of a change of the alternating electric field conducted by said alternating electric field changing means.

10. An image forming apparatus according to claim 7, wherein said apparatus further comprises environmental condition adjusting means for, in accordance with environmental conditions, controlling a degree of a change of the alternating electric field conducted by said alternating electric field changing means, and a degree of a change of the transfer force conducted by said transfer force changing means.

* * * * *